US010361483B2

(12) United States Patent
Maruyama et al.

(10) Patent No.: US 10,361,483 B2
(45) Date of Patent: Jul. 23, 2019

(54) ANTENNA DEVICE AND ARRAY ANTENNA DEVICE

(71) Applicant: Mitsubishi Electric Corporation, Tokyo (JP)

(72) Inventors: Takashi Maruyama, Tokyo (JP); Satoshi Yamaguchi, Tokyo (JP); Masataka Otsuka, Tokyo (JP); Masatake Hangai, Tokyo (JP); Naoyuki Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 362 days.

(21) Appl. No.: 15/324,879

(22) PCT Filed: Aug. 3, 2015

(86) PCT No.: PCT/JP2015/071940
§ 371 (c)(1),
(2) Date: Jan. 9, 2017

(87) PCT Pub. No.: WO2016/021544
PCT Pub. Date: Feb. 11, 2016

(65) Prior Publication Data

US 2017/0207529 A1 Jul. 20, 2017

(30) Foreign Application Priority Data

Aug. 6, 2014 (WO) ..... PCT/JP2014/004106

(51) Int. Cl.
*H01Q 3/24* (2006.01)
*H01Q 21/08* (2006.01)
(Continued)

(52) U.S. Cl.
CPC ..... *H01Q 3/24* (2013.01); *H01Q 3/44* (2013.01); *H01Q 9/0485* (2013.01); *H01Q 19/28* (2013.01); *H01Q 21/08* (2013.01)

(58) Field of Classification Search
CPC ..... H01Q 3/24; H01Q 9/0485; H01Q 19/28; H01Q 21/08; H01Q 3/44; H01Q 1/38;
(Continued)

(56) References Cited

U.S. PATENT DOCUMENTS 5,293,172 A 3/1994 Lamberty et al.
7,330,152 B2 2/2008 Zhang et al.
(Continued)

FOREIGN PATENT DOCUMENTS

JP H06-069723 A 3/1994
JP 2001-024431 A 1/2001
(Continued)

OTHER PUBLICATIONS

International Search Report issued in PCT/JP2015/071940; dated Oct. 20, 2015.
(Continued)

*Primary Examiner* — Hai V Tran
*Assistant Examiner* — Michael M Bouizza
(74) *Attorney, Agent, or Firm* — Studebaker & Brackett PC

(57) ABSTRACT

The antenna device includes: an element part 100 having an excitation element 1, a first passive element 11 having first and second conductive parts 11*a* and 11*b*, a second passive element 21 having third and fourth conductive parts 21*a* and 21*b*, a first switch 12 controlling conduction between the first and second conductive parts, and a second switch 22 controlling conduction between the third and fourth conductive parts; and a controller 200 outputting an electric signal for controlling conduction of the first and second switches.
(Continued)

The controller outputs identical DC signal to the first and second switches, and one of the first and second switches is brought into conduction while the other one is brought out of conduction.

10 Claims, 10 Drawing Sheets

(51) Int. Cl.

| | |
|---|---|
| ***H01Q 9/04*** | (2006.01) |
| ***H01Q 3/44*** | (2006.01) |
| ***H01Q 19/28*** | (2006.01) |

(58) Field of Classification Search
CPC ..... H01Q 9/16; H01Q 9/065; H01Q 19/30; H01Q 9/0407
See application file for complete search history.

(56) References Cited

U.S. PATENT DOCUMENTS

| | | | | |
|---|---|---|---|---|
| 7,602,340 | B2 * | 10/2009 | Sato | H01Q 3/44 343/700 MS |
| 7,656,360 | B2 * | 2/2010 | Hirabayashi | H01Q 3/44 343/818 |
| 2007/0229357 | A1 | 10/2007 | Zhang et al. | |
| 2011/0193761 | A1 | 8/2011 | Shinkai et al. | |

FOREIGN PATENT DOCUMENTS

| | | | |
|---|---|---|---|
| JP | 3672770 | B2 | 7/2005 |
| WO | 2010/041436 | A1 | 4/2010 |

OTHER PUBLICATIONS

Y.Bai et al.; Wide-Angle Scanning Phased Array With Pattern Reconfigurable Elements; IEEE Transactions on Antennas and Propagation; Nov. 2011; pp. 4071-4076; vol. 59, No. 11.

* cited by examiner

ANTENNA DEVICE AND ARRAY ANTENNA DEVICE

TECHNICAL FIELD

The present invention typically relates to an antenna device used for radio communications. Particularly, it relates to an antenna device having controllable directional characteristics.

BACKGROUND ART

As an example of conventional antenna devices whose directional characteristics are changeable, a technique which is applied to the Yagi-Uda antenna consisting of three elements is known (Patent Literature 1).

The antenna device disclosed in Patent Literature 1 includes one excitation element (described as Driven element in the Figures of patent literature 1) to which a radio frequency signal is fed, and two passive elements (described as Passive elements in the Figures of Patent Literature 1) which are respectively disposed on both sides across the excitation element and to which no radio frequency signal is fed. Further, switches (described as Optoelectronic switches in the FIGS. of Patent Literature 1) to control conduction characteristics by using light are connected at certain midpoints between both end portions of each of the two passive elements, and, for each of the two passive elements, light is applied as a control signal from an individual laser light source to each of the switches.

When switches are open (described as Open in Patent Literature 1), the portion between a central portion of the passive element and end portions of the passive element where the switches are disposed are electrically non-connected to each other, and therefore the antenna functions as a director. In contrast, when switches are closed (described as Closed in Patent Literature 1), the portions between the central portion and the end portions where the switches are disposed are electrically connected with each other, and therefore the antenna functions as a reflector.

The antenna device is further configured so that the conduction and non-conduction of the switches are reversible between the two passive elements by controlling the existence or non-existence of light from each laser light source, thereby making the directional characteristics of the antenna device changeable.

Further, a technique of arranging a plurality of antennas having controllable directional characteristics as above as a unit antenna to configure an array antenna device is known (Non Patent Literature 1).

The array antenna device disclosed in Non Patent Literature 1 is configured in such a way that switches in each passive element (described as a Parasitic strip in Non Patent Literature 1) disposed in each unit antenna are all controlled by a direct current signal in a same way.

In the above-mentioned explanation of background of the invention and in the following explanation of the present invention, the terms "electrical conduction" and "electrical non-conduction" do not necessarily have to mean strict electrical conduction and non-conduction characteristics, respectively, and antenna devices have only to have electrical conduction characteristics and electrical non-conduction characteristics which are required to such an extent that the antenna devices satisfy the performance necessary thereto.

CITATION LIST

Patent Literature

Patent Literature 1: U.S. Pat. No. 5,293,172

Non Patent Literature

Non Patent Literature 1: Yan-Ying Bai, et. al. "Wide-Angle Scanning Phased Array With Pattern Reconfigurable Elements" IEEE Trans on AP, vol. 59, no. 11, November 2011, pp. 4071-4076

SUMMARY OF INVENTION

Technical Problem

A problem with the antenna device disclosed in Patent Literature 1 is that the antenna device requires an optical system including laser light sources and optical fibers, and therefore the cost of the configuration for controlling the directional characteristics becomes high.

Another problem is that because it is necessary to arrange a laser light source and an optical fiber, which serve as a control line, for each passive element, and control each passive element individually, the configuration for controlling the directional characteristics is complicated.

A problem with the array antenna device disclosed in Non Patent Literature 1 is that while the array antenna device is configured so as to perform control of switches on the basis of an electric signal, the number of control lines increases proportionally with increase in the number of unit antennas disposed.

The present invention is made in order to solve the above-mentioned problems, and it is therefore an object of the present invention to provide an antenna device that can simplify its configuration for a control operation of making directional characteristics changeable, and an array antenna device that can prevent its configuration for controlling directional characteristics from becoming complicated even if the number of unit antennas disposed increases.

Solution to Problem

According to the present invention, there is provided an antenna device including: an element part having an excitation element having a feed point for a radio frequency signal; a first passive element disposed at a position apart from the excitation element and having first conductive part and second conductive part; a second passive element disposed at a position apart from the excitation element and the first passive element, and having third conductive part and fourth conductive part; a first switch having two operating states of conduction and non-conduction, to switch between electrical connection between the first and second conductive parts, and electrical non-connection between the first conductive part and second conductive part; a second switch having two operating states of conduction and non-conduction, to switch between electrical connection between the third conductive part and fourth conductive part, and electrical non-connection between the third conductive part and fourth conductive part; a first line extending in parallel with the first passive element and connected to the second conductive part; a second line extending in parallel with the second passive element and connected to the fourth conductive part; a third line connecting between the first conductive part and the third conductive part; and a fourth line connecting between the first line and the second line. The antenna device further includes: a controller to output an electric signal for controlling the conduction and the non-conduction of each of the first and second switches. The antenna device further includes: a first dielectric substrate; and second dielectric substrate having a fixed arrangement relationship with the first dielectric substrate. The excitation element is disposed on one main surface of the first dielectric substrate, the first and second passive elements, the first and second switches, and the third line are disposed on one main surface of the second dielectric substrate, and the first, second and fourth lines are disposed on another main surface of the second dielectric substrate. The controller outputs an identical direct current signal, as the electric signal, to the first and second switches by applying a direct current signal between the third and fourth lines. When the identical direct current signal is outputted from the controller, one of the first and second switches is brought into conduction while the other one of the first and second switches is brought out of conduction.

Advantageous Effects of Invention

According to the antenna device of the present invention, it is possible to simplify the configuration for a control operation of making directional characteristics changeable.

Further, it is possible to provide an array antenna device that can prevent its configuration for control from becoming complicated even if the number of unit antennas disposed increases.

DESCRIPTION OF EMBODIMENTS

Figure 1:
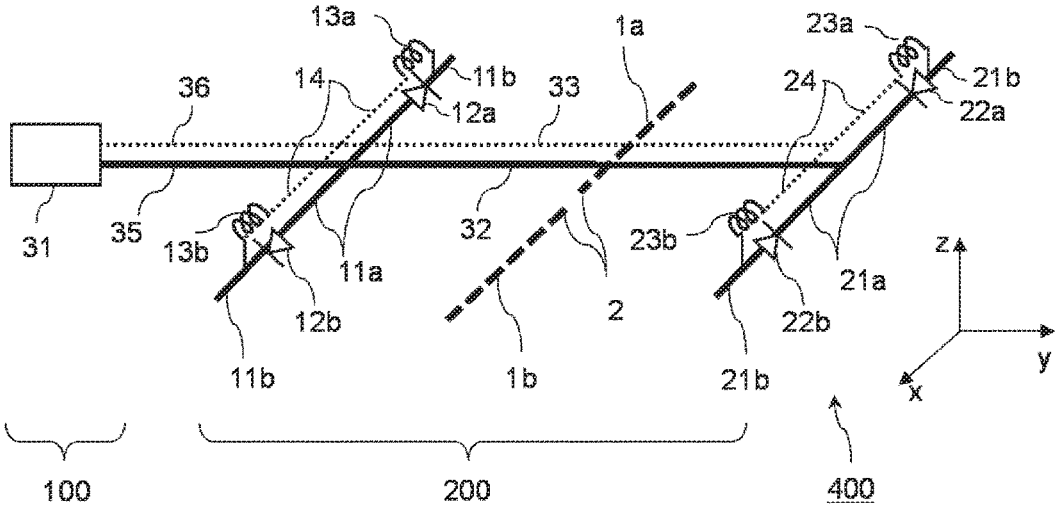
FIG. 1 is a perspective view showing an overview of an antenna device according to an Embodiment 1 of the present invention.

In the following, each embodiment of the present invention will be explained with reference to the accompanying drawings.

In the drawings of each embodiment explained hereinafter, there are cases in which the same or similar components are denoted by the same or similar reference numerals, and the description and the explanation of each component will be omitted in the explanation of each embodiment. Further, in the following explanation, there are cases in which the letter a or b is attached to the reference numerals in order to discriminate each part in one component, and when one component is explained as a whole, the explanation will be made using the reference numeral without the letter a or b.

Further, each component shown in each of the drawings is a part divided for the sake of convenience in order to explain the present invention, and the implementation example of each component is not limited to the configuration, the division, names, etc. in each of the drawings. Further, also the dividing pattern and the interrelationship among the components after division are not limited to those shown in each of the drawings.

Further, in the following explanation, some or all of names each with " . . . part" may be replaced by other names in accordance with the implementation of the antenna device. For example, some or all of the names are replaced by " . . . means", " . . . devices", " . . . processing devices", " . . . functional modules", or " . . . circuits", and the present invention is not limited to their names.

Embodiment 1

Hereinafter, Embodiment 1 of the present invention will be explained with reference to FIGS. 1 to 3.

In this embodiment, an example of an application to the Yagi-Uda antenna having three elements will be explained for the sake of simplicity of explanation without losing the generality. However, the number of elements is not limited to three. Further, although this embodiment is an example in which components disposed symmetrically have the same characteristics, this embodiment is not limited to the example in which the components are disposed strictly symmetrically and have the same characteristics, and it is only required for the components to have characteristics necessary to the antenna device.

FIG. 1 is a perspective view showing an overview of an antenna device according to the Embodiment 1 of the present invention.

In this FIG. 1 (1*a* and 1*b*) denotes an excitation element, 2 denotes a feed point, 11 (11*a* and 11*b*) denotes a first passive element, 11*a* denotes a first conductive part, 11*b* denotes a second conductive part, 12 (12*a* and 12*b*) denotes a first switch (or a PIN diode), 13 (13*a* and 13*b*) denotes a first interrupter (or an inductor), 14 denotes a first line, 21 (21*a* and 21*b*) denotes a second passive element, 21*a* denotes a third conductive part, 21*b* denotes a fourth conductive part, 22 (22*a* and 22*b*) denotes a second switch (or a PIN diode), 23 (23*a* and 23*b*) denotes a second interrupter (or an inductor), 24 denotes a second line, 31 denotes a control circuit, 32 denotes a third line, 33 denotes a fourth line, 35 and 36 denote a line pair, 100 denotes a controller, 200 denotes an element part, 400 denotes the antenna device, and x, y, and z denote coordinate axes expedientially attached.

In the implementation of the antenna device 400, various types of antenna devices in a broad sense each including components not shown in the diagrams can be defined. For example, the antenna device can include (1) a radio frequency signal source, (2) a feeder line, (3) a radio transmission (or reception) control circuit, (4) various types of information processing circuits, (5) various analog devices such as a filter, (6) a power supply, (7) a housing, and (8) various types of interfaces such as an interface for display.

The controller 100 includes a control circuit 31 for controlling directional characteristics. The control circuit 31 will be described later.

The element part 200 includes the excitation element 1, the first passive element 11, the second passive element 21, the first switches 12, the second switches 22, the first interrupters 13, the second interrupters 23, the first line 14, the second line 24, the third line 32, and the fourth line 33.

The controller 100 (control circuit 31) and the element part 200 are electrically connected to each other via the line pair 35 and 36.

In this embodiment, as an example of the excitation element 1 (1*a* and 1*b*), a dipole antenna is provided. Further, the excitation element 1 has feed points 2 for transmission and reception of a radio frequency signal.

Note that, the feed point is a connection point at which the elements of the antenna and a feeder line for supplying high-frequency power are connected to each other, and there is a case in which each feed point is not a specific point, but has an area spreading to some extent, dependently upon the shape of the excitation element 1 or the like. Further, there is a case in which the excitation element 1 is called a Feed element.

In addition, the excitation element 1 functions as what is called a radiating element in the operation of the antenna device.

The first passive element 11 is disposed at a position apart from the excitation element 1. The gap between the passive element 11 and the excitation element 1 is determined in such a way that the first passive element 11 functions as a director or a reflector.

This embodiment is an example in which the first passive element 11 and the second passive element 21 are disposed on the same plane, the excitation element 1 is disposed apart from the above-mentioned plane, and the gap between the above-mentioned plane and the excitation element 1 is shorter than the wavelength of the radio frequency signal.

Further, in this embodiment, the excitation element 1 is disposed apart from the third line 32 and the fourth line 33, and disposed in such a way as to be not electrically connected to the third line 32 and the fourth line 33.

Further, the first passive element 11 includes the first conductive part 11*a*, and a part 11*b*. The first conductive part 11*a* and the second conductive part 11*b* are disposed separately from each other.

In the explanation of the present invention, for the following terms: "electrical connection or conduction" and "electrical non-connection or non-conduction", there are a case in which, for example, the terms are used as electrical connection and electrical non-connection between two components, like the case of the first passive element, and a case in which, for example, the terms are used as conduction and non-conduction which one component, like each first switch 12, can have as its state (i.e., in each switch, conduction and non-conduction between its terminals). Further, in the explanation of the present invention, the terms do not necessarily have to mean only strict electrical connection or conduction and strict electrical non-connection or non-conduction, respectively, and it is enough for those states to have characteristics which are required to the antenna device to satisfy the performance necessary thereto.

In some cases, the first passive element 11 is called a non-feeding element (Passive element) because it does not have a feed point.

Each of the first switches 12 (12*a* and 12*b*) is connected to the first conductive part 11*a* and a second conductive part 11*b*. Further, each of the first switches 12 switches between the electrical connection and the electrical non-connection between the first conductive part 11*a* and the second conductive part 11*b* at the radio frequency, by switching the operating state of the switch between the conduction and the non-conduction.

This embodiment is an example in which a PIN diode is used as each of the first and second switches. Namely, in the first passive element 11, PIN diodes 12 each of which functions as a switch are disposed at some midpoints of the first passive element.

Further, each of the PIN diodes 12*a* and 12*b* has an anode connected to the first conductive part 11*a*, and a cathode connected to a second conductive part 11*b*.

The first interrupters 13 (13*a* and 13*b*) has interrupt characteristics at an assumed radio frequency (or in an assumed radio frequency band). This embodiment is an example in which an inductor is used as the interrupter.

Further, as shown in the drawings, the PIN diodes 12*a* and 12*b* are disposed so as to be oriented in directions opposing to each other.

The first line 14 is conductive, extends in parallel with the first passive element 11, and is connected to the second conductive parts 11*b* via the first interrupters 13. Note that, the term "in parallel with" does not necessarily mean "in strictly parallel with" in this invention, and simply means a degree of parallelism which is required to such an extent that the antenna device satisfies a performance necessary thereto, or to such an extent that there is no problem in implementing the present invention.

This embodiment is an example in which the gap between the first line 14 and the first passive element is shorter than the wavelength of the radio frequency signal.

Further, the first line 14 is connected to the second conductive parts 11*b* via the first interrupters 13.

The second passive element 21 is disposed at a position apart from the excitation element 1 and the first passive element 11. Further, the second passive element 21 includes the third conductive part 21*a* and the fourth conductive parts 21*b*, and the third conductive part 21*a* and the fourth conductive parts 21*b* are disposed separately from each other.

This embodiment is an example in which the passive elements are disposed respectively on both sides across the excitation element 1 when, for example, the antenna is viewed in the planar view from the upper side (the direction of z) of the diagram.

Because the second passive element 21 is configured in the same way as the above-mentioned first passive element 11, the explanation of the second passive element will be omitted.

Each of the second switches 22 (22*a* and 22*b*) is connected to the third conductive part 21*a* and a fourth conductive part 21*b*. Further, each of the second switches 22 switches between the electrical connection and the electrical non-connection between the third conductive part 21*a* and the fourth conductive part 21*b* at radio frequencies, by switching the operation of the switch between the conduction and the non-conduction.

Because each of the second switches 22 (22*a* and 22*b*) is configured in the same way as each of the first switches 12 mentioned above, the explanation of the second switches will be omitted.

However, note that, each of the PIN diodes 22*a* and 22*b* which functions as a switch has an anode connected to a fourth conductive part 21*b*, and a cathode connected to the third conductive part 21*a*.

Therefore, the diodes 22*a* and 22*b* shown in the diagram are disposed and connected in such a way that the diodes are oriented in the directions opposite to those of the PIN diodes 12*a* and 12*b* which function as the first switches, respectively.

Because the second interrupters 23 (23*a* and 23*b*) are configured in the same way as the above-mentioned first interrupters 13, the explanation of the second interrupters will be omitted.

Because the second line 24 is configured in the same way as the above-mentioned first line 14, the explanation of the second line will be omitted.

The gap between the first passive element 11 and the first line 14 and the gap between the second passive element 21 and the second line 24 will be explained in a second embodiment.

The control circuit 31 outputs a control signal for controlling the conduction and the non-conduction of the first switches 12 (12*a* and 12*b*) and those of the second switches 22 (22*a* and 22*b*) at radio frequencies.

In this embodiment, as a control signal, a direct current signal applied between the lines 35 and 36 is used. However, when switching of each of the switches is performed at a high speed, there is a case that the control signal is assumed to be substantially an alternating current signal.

The third line 32 is conductive, and connects between the first conductive part 11*a* and the third conductive part 21*a* and is also connected to the line 35.

The fourth line 33 is conductive, and connects between the first line 14 and the second line 24 and is also connected to the line 36.

As explained above, this embodiment is an example in which the parts are symmetrically disposed and connected as a whole, respectively, on both sides across the straight line connecting between the connection points of each of the first and third conductive parts 11*a* and 21*a* and the third line 32, when the element part 200 is viewed in the planar view from the upper side of the diagram.

Next, the operation of the antenna device 400 according to this embodiment will be explained.

In the following explanation, a case in which the antenna device 400 transmits a radio frequency signal, namely, a radio frequency signal is emitted as a radio wave from the antenna will be explained as an example. The antenna device 400 can also be used similarly for receiving a radio wave.

A radio frequency signal is fed to the excitation element 1 via the feed points 2.

The control circuit of the controller 100 applies a direct current signal between the line 35 and the line 36, as the electric signal for switching between the conduction and the non-conduction of each of the switches 12 and 22.

The line 35 is connected to each of the PIN diodes via the line 32, the first conductive part 11*a* and the third conductive part 21*a*, and the line 36 is connected to each of the PIN diodes via the fourth line 33, the first line 14 and the second line 24. The direct current signal which is applied between the lines 35 and 36 by the controller 100 (control circuit 31) is branched into parts, and these parts serve as DC (Direct Current) biases applied to the PIN diodes, respectively. As a mode of control of the biases, a control in voltage can be used. As an alternative, a control in current can be used.

While each of the interrupters (inductors) 13 and 23 has interrupt characteristics at radio frequencies, the DC bias, which is the control signal from the controller 100 (control circuit 31), can pass through the interrupters.

Each of the PIN diodes 12 and 22 allows a radio frequency signal to pass therethrough when a forward bias is applied thereto. For example, in the first switch 12 (12*a* and 12*b*), an electrical connection is established between the first conductive part 11*a* and a second conductive parts 11*b*. As a result of this electrical connection, the electric length of the first passive element 11 becomes longer than that of the excitation element 1, and the first passive element therefore functions as a reflector. The PIN diode of the second switch 22 (22*a* and 22*b*) functions in the same way.

In contrast, when the reverse bias is applied to each of the PIN diodes 12 and 22, the switch becomes non-conduction state. For example, in the first switch 12 (12*a* and 12*b*), no electrical connection is established between the first conductive part 11*a* and a second conductive part 11*b*. As a result of this electrical non-connection, the second conductive parts 11*b* do not contribute to the antenna operation effectively at radio frequencies. Therefore, the electric length of the first passive element 11 becomes shorter than that of the excitation element 1, and therefore the first conductive part 11*a* functions as a director. The second passive element 21 functions in the same way.

While the direct current signal from the controller 100 is applied to the element part 200 with the direct current signal being branched toward both the first passive element 11 and the second passive element 21, when either the first switches 12 or the second switches 22 are brought into conduction, the other switches are brought out of conduction, because the PIN diodes of the first passive element 11 and those of the second passive element 21 are connected in the opposite directions to each other.

Therefore, even if a DC bias is applied to each of the PIN diodes by using an identical direct current signal as the control signal, because when one of the passive elements functions as a reflector, the other passive element functions as a director. As a result, the directional characteristics of the antenna are changed.

Figure 2:
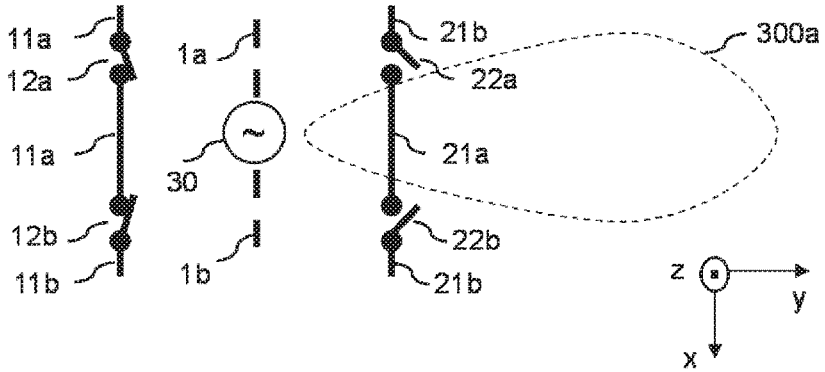
FIG. 2 is a diagram showing a state of each switch and a main lobe in directional characteristics, in the Embodiment 1 of the present invention.
Figure 3:
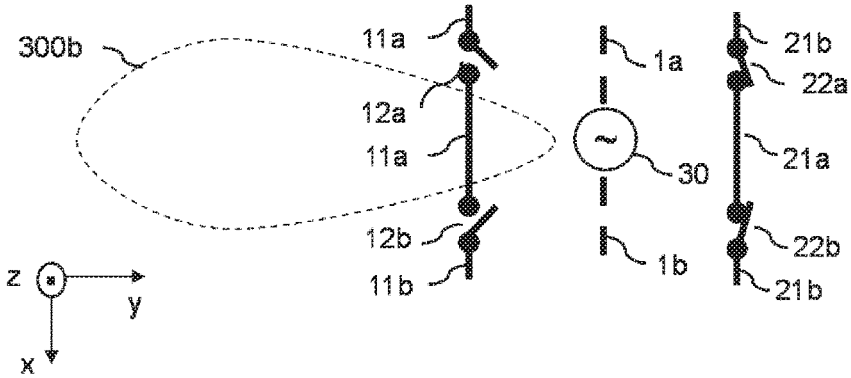
FIG. 3 is a diagram showing a state of each switch and a main lobe in the directional characteristics, in the Embodiment 1 of the present invention.

FIGS. 2 and 3 are diagrams showing the state of each of the switches and the main lobe in the directional characteristics, in the Embodiment 1 of the present invention.

FIG. 2 shows an example of the x-y plane and the main lobe which is emitted at the time that the first switches 12 are brought into conduction while the second switches 22 are brought out of conduction.

Because the first passive element 11 functions as a reflector and the second passive element 21 functions as a director in the state shown in the diagram, the main lobe is oriented toward the direction of y (the right side of the diagram).

FIG. 3 shows an example of the x-y plane and the main lobe which is emitted at the time that the first switches 12 are in the non-conduction state while the second switches 22 are in the conduction state.

Because the first passive element 11 functions as a director and the second passive element 21 functions as a reflector in the state shown in the diagram, the main lobe is oriented toward the direction of –y (the left side of the diagram).

It can be seen from the above description that the antenna device according to this embodiment provides two types of directional characteristics and can make its radiation pattern changeable.

As described above, because the antenna device according to this embodiment is configured in such a way that the polarities of the PIN diodes 12 disposed as the first switches are opposite to the polarities of the PIN diodes 22 disposed as the second switches, and both of the PIN diodes 12 and 22 are controlled via the common control lines (the line 32 and the line 33) in the element part 200, the controller 100 (control circuit 31) and control signals can be unified into one, and the configuration for controlling the passive elements can be simplified.

Therefore, in an antenna device, it is possible to simplify the configuration for controlling the directional characteristics to be changeable.

Further, in this embodiment, because PIN diodes are used as the switches, the switching between the conduction and the non-conduction as the switching operation of each of the switches can be sped up, and therefore the directional characteristics of the antenna device can be switched at a high speed.

Further, the first line 14 extends in parallel with the first passive element 11, the second line 24 extends in parallel with the second passive element 21, and each of the first and second lines is disposed with a gap between itself and the corresponding passive element, the gap being shorter than the wavelength of the radio frequency.

As a result, the first line 14 does not make a substantial influence, such as interference, on the first conductive part 11*a*, or functions substantially integrally with the first conductive part, so that undesired influence on the antenna performance can be reduced. This is same for the second line 24.

Further, in this embodiment, the second passive element 21 is disposed on the same plane as the first passive element 11, and the excitation element 1 is disposed apart from the above-mentioned plane.

As a result, the third line 32 connecting between the first conductive part 11 and the third conductive part 21 and the fourth line 33 connecting between the first line 14 and the second line 24 can be reduced in length to the minimum, and increase in the size of the antenna device can be suppressed.

Further, in this embodiment, because the components explained above are symmetrically disposed and connected, and the lines 32, 33, 35 and 36 are disposed along the axis of symmetry, as the configuration of the element part 200, the interference of the radio frequency signal with the lines 32 and 33 is reduced, the necessity to take a measure in order to interrupt the radio frequency by additionally placing an interrupter on each of the lines is decreased, and increase in the production cost of the antenna device can be suppressed.

Further, the first and second passive elements 11 and 21 are disposed on the same plane, and the excitation element 1 is disposed apart from the plane on which the passive elements are disposed. Because the gap between the plane on which the passive elements are disposed and the excitation element 1 is shorter than the wavelength of the radio frequency signal, the difference between the characteristics in this embodiment and the characteristic in a case in which the excitation element is disposed on the same plane can be reduced.

Further, the interrupters 13 and 23 each having interrupt characteristics at radio frequency are disposed, and the first line 14 is connected to the second conductive parts 11 via the first interrupters 13 and the second line 24 is connected to the fourth conductive parts 21*b* via the second interrupters 23.

As a result, the possibility that, independently of the conduction (non-conduction) of the switches, the radio frequency signal disadvantageously propagates to the second conductive parts 11*b* and the fourth conductive parts 21*b*, and, as a result, the passive elements does not function as a director can be suppressed.

Although in this embodiment the case in which PIN diodes are used as the switches 12 and 22 is explained, any type of switches can be applied as long as they use a DC electric signal as the control signal and function as switches for the radio frequency signal. For example, (1) varactor diodes or (2) relay switches can be used.

In this case, it is desirable that in each of the switches a terminal for the conduction and the non-conduction can also be used as a terminal to which a signal for control is applied, like in the case of this embodiment.

For example, in a case in which varactor diodes are used as the switches, the varactor diodes operate, as the switching operations of the switches, in the same way that the PIN diodes operate, but the transition between the "conduction" state and the "non-conduction" state changes slowly compared with that of the PIN diodes. Therefore, the range of selection of the switches can be broadened in accordance with the usage purpose of the antenna device 400, and also elements other than switches can be used together.

Further, although in this embodiment the example in which when a direct current signal is applied from the controller 100 to the first and second switches, the switches are placed, as a whole, in one of the following two states: the state in which the first switches 12 are brought into conduction while the second switches 22 are brought out of conduction; and the state in which the first switches 12 are brought out of conduction while the second switches 22 are brought into conduction is explained, the switches can be alternatively configured so as to enter one of three states, in addition to the above-mentioned two states, including a state in which no direct current signal is applied.

Namely, the switches can be configured so as to, when no direct current signal is applied, enter either a state (1) in which both the first and second switches 12 and 22 are brought out of conduction, or a state (2) in which both the first and second switches 12 and 22 are brought into conduction.

In the state (1), both the PIN diodes 12 and 22, which are the switches, are not biased (or have a zero bias), the PIN diodes do not allow the radio frequency signal to pass therethrough, and both the passive elements 11 and 21 function as directors. On the other hand, in the state (2), because the PIN diodes 12 and 22 allow the radio frequency signal to pass therethrough, both the passive elements 11 and 21 function as reflectors.

Embodiment 2

Hereinafter, Embodiment 2 of the present invention will be explained with reference to FIG. 4.

Note that, there is a case in which the explanation of the same components as those explained in the above-mentioned Embodiment 1 and the operations of the components is omitted.

Figure 4:
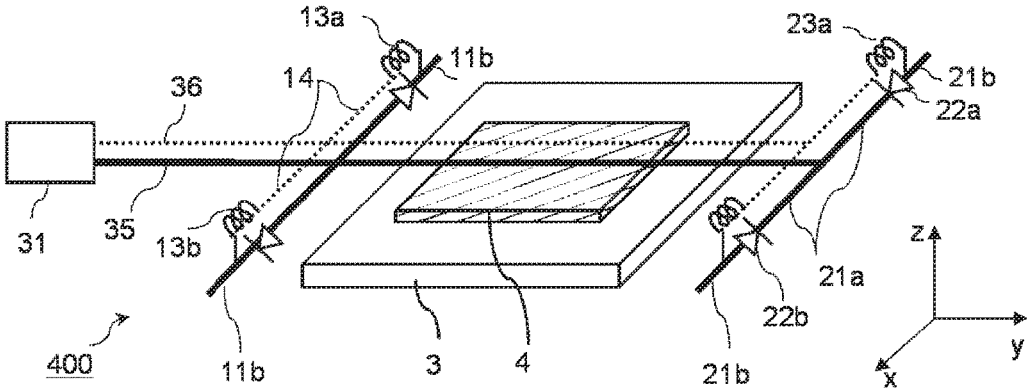
FIG. 4 is a perspective view showing an overview of an antenna device according to an Embodiment 2 of the present invention.

FIG. 4 is a perspective view showing an overview of an antenna device according to the Embodiment 2 of the present invention.

This embodiment differs from the above-mentioned Embodiment 2 in that the antenna device adopts, as the type of excitation element, a patch antenna type.

In the diagram, 3 denotes a dielectric substrate, and 4 denotes a patch. The other components used for configuration are the same as those described in the Embodiment 1.

In the patch antenna, the conductive patch 4 is formed on a main surface of the dielectric substrate 3. The patch can be made from a conductive material such as a metallic material.

Because the configuration of the patch antenna shown in the diagram is merely an example, and the shape of the patch and the position of a feed point differ in accordance with the configuration and the performance of the patch antenna, the feed point is not illustrated in the diagram.

For example, the feed point of the patch 4 can be disposed on the surface on the side of the dielectric substrate (in the diagram, the lower surface) which is fed from the rear surface of the dielectric substrate via a through hole.

Further, a conductive layer (not shown in the diagrams) serving as a ground plane is formed on another main surface (in the diagram, the lower surface) which is opposite to the main surface, on which the patch 4 is disposed, across the dielectric substrate 3.

Further, similarly to the case of Embodiment 1, the patch antenna which is an excitation element is configured so as to be disposed apart from the plane on which passive elements 11 and 21 are disposed, and have a gap between itself and the plane which is shorter than the wavelength of a radio frequency signal.

Because the other components and the operations of these components are the same as those according to the Embodiment 1, the explanation of the components and the operations will be omitted.

Figure 7:
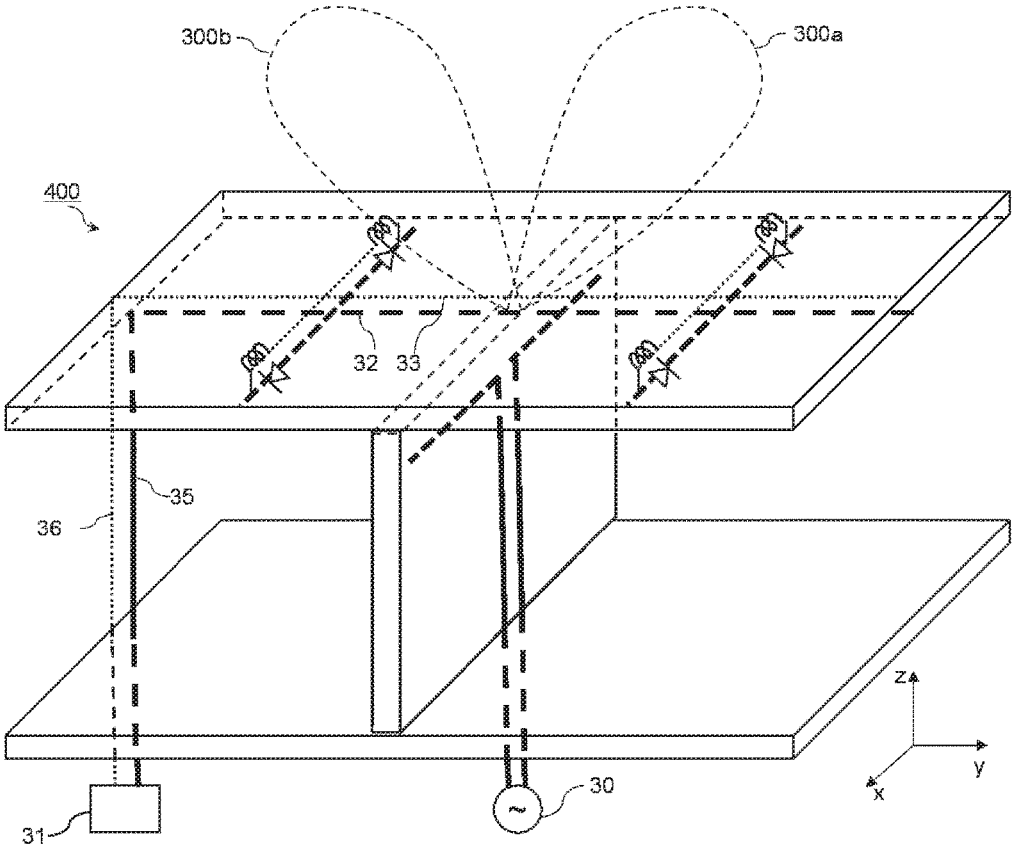
FIG. 7 is a diagram showing a main lobe in directional characteristics in the Embodiment 3 of the present invention.

In this embodiment, because the conductive layer (not shown in the diagrams) is formed on the main surface of the dielectric substrate 3 and functions as a reflecting plate in the antenna device 400, the radio wave radiated from the antenna device 400 is radiated into half space in the direction of +z (in the direction of the upper side of the diagram). Therefore, the main lobe is oriented toward the direction of +z regardless of the control of the switches of the passive elements, and is also oriented toward the direction of +y or the direction of −y in accordance with the control (for example, refer to FIG. 7 shown in the Embodiment 3 which will be described later).

Thus, also in the case in which the antenna type of the excitation element 1 is changed, the control can be applied to the passive elements according to the present invention.

As described above, the antenna device according to this embodiment provides the same effects as those provided by the aforementioned Embodiment 1.

Further, since the present invention is not limited to the excitation element of dipole antenna type described in the Embodiment 1, and the present invention can be applied to an antenna device having a different type of excitation element.

Embodiment 3

Hereinafter, Embodiment 3 of the present invention will be explained with reference to FIGS. 5 to 7.

Note that, there is a case in which the explanation of the same or similar components and operations of the components as those explained in the above-mentioned Embodiment 1 is omitted.

Figure 5:
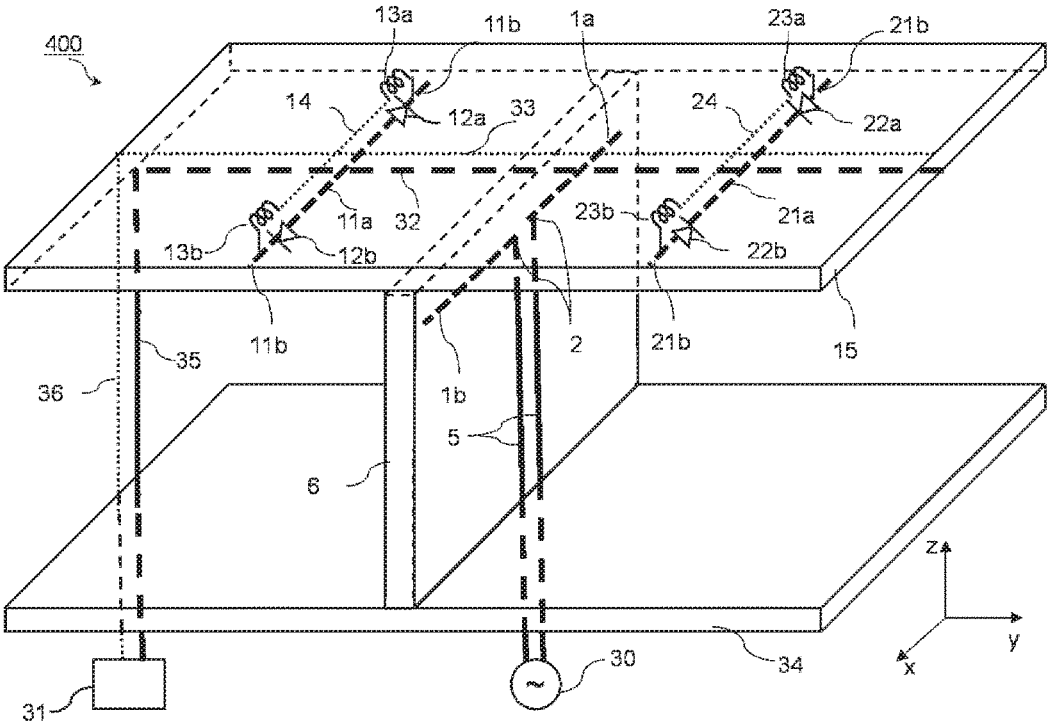
FIG. 5 is a perspective view showing, in a transparent view, an overview of an antenna device according to an Embodiment 3 of the present invention.

FIG. 5 is a perspective view showing, in a transparent view, an overview of an antenna device according to the Embodiment 3 of the present invention.

The antenna device according to this embodiment differs from that of the Embodiment 1 mainly in that an excitation element 1 and passive elements 11 and 22 are disposed on different substrates, and a reflecting plate is formed.

Namely, this embodiment is an example of a three-element Yagi-Uda antenna with a reflecting plate.

In the diagram, 5 denotes a feeder line, 6 denotes a first dielectric substrate, 15 denotes a second dielectric substrate, 30 denotes a radio frequency signal source, and 34 denotes a reflecting plate. The other components are the same as those according to the Embodiment 1.

The feeder line 5 connects between the radio frequency signal source 30 and the excitation element 1, and feeds a signal from the radio frequency signal source 30 to the excitation element 1 via feed points 2.

As the implementation of the feeder line 5, various types of feeder lines can be applied. For example, any of (1) an electric wire, (2) a coaxial cable, (3) a strip line, and (4) a waveguide can be applied.

The dipole antenna 1 and the feeder line 5, which are shown in the diagram, can be formed so as to function together as the excitation element 1. In this case, connection points at which the feeder line 5 and the radio frequency signal source 30 shown in the diagram are connected to each other serve as the feed points.

In the first dielectric substrate 6, the dipole antenna 1 which is the excitation element is disposed on one main surface thereof.

In the second dielectric substrate 15, the passive element 11, PIN diodes 12 and 22 which are switches, and a third line 32 are disposed on one main surface thereof (in the diagram, the lower surface of the substrate). Further, inductors which are a first interrupter 13 and a second interrupter 23, a first line 14, a second line 24, and a fourth line 33 are disposed on another main surface of the second dielectric substrate 15 (in the diagram, the upper surface of the substrate).

Further, the first dielectric substrate 6 and the second dielectric substrate 15 are disposed to have a fixed arrangement relationship, in such a way that the dipole antenna 1 functions as an excitation element, and the first to fourth conductive parts 11 and 21 function as passive elements. The first dielectric substrate and the second dielectric substrate can be formed individually, or can be formed integrally.

This embodiment is an example in which the first dielectric substrate 6 and the second dielectric substrate 15 are secured to each other at a right angle.

The reflecting plate 34 is made from a conductive material, e.g., a metallic material.

In this embodiment, the reflecting plate 34 is disposed in parallel with the second dielectric substrate 15, and is disposed so as to have a fixed arrangement relationship with the dielectric substrate 6. The whole of the reflecting plate does not have to have conductivity as long as the reflecting plate functions as a reflector. For example, the reflecting plate can be formed in such a way that its portion on the upper side in the diagram has conductivity and its portion on the lower side in the diagram has non-conductivity.

Further, this embodiment is an example in which the first dielectric substrate 6 and the reflecting plate 34 are secured to each other at a right angle. Therefore, the second dielectric substrate 15 and the reflecting plate are disposed in parallel with each other.

The radio frequency signal source 30 generates a radio frequency signal from which a radio wave radiating from the antenna device 400 is generated.

This embodiment is an example in which the feeder line 5, a line 35, and a line 36 are arranged to penetrate the reflecting plate 34, and are connected to the radio frequency signal source 30 and a control circuit 31 which are disposed on the main surface of the reflecting plate 34 to which the dielectric substrate 6 is not secured.

As the implementation of the line 35 and the line 36 in the portion between the second dielectric substrate 15 and the reflecting plate 34, various types of lines can be applied. For example, (1) an electric wire or (2) a strip line formed on a dielectric substrate (not shown in the diagrams) can be applied.

Figure 6A:
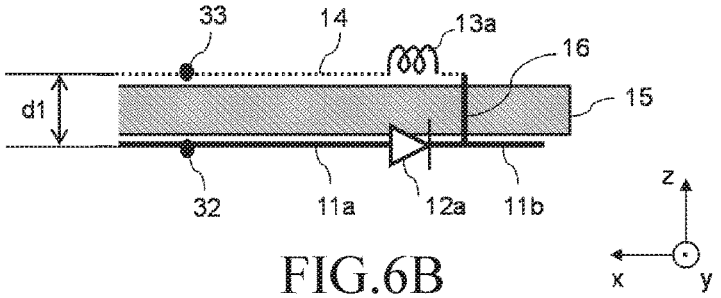
FIG. 6A and FIG. 6B are diagrams showing a cross-sectional configuration (partial configuration) in the Embodiment 3 of the present invention.
Figure 6B:
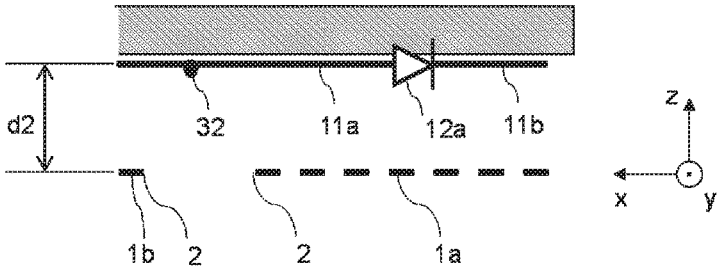

FIG. 6A and FIG. 6B are diagrams showing a cross-sectional configuration (partial configuration) of the element part in the Embodiment 3 of the present invention.

FIG. 6A shows a cross section of a portion around a second switch 12*b* in the x-z plane of the second dielectric substrate 15, at the position of the first passive element 11 with respect to the direction of y.

The above configuration is considered to be similar to a case of a cross section around each of the other switches.

In the diagram, 16 denotes a through hole, and d1 denotes the gap between the first line 14 and the first passive element 11 with respect to the direction of z.

The through hole 16 is formed of a conductive material, e.g., a metallic material.

The inductor 13*a* which is the first interrupter, and a second conductive part 11*b* and the PIN diode 12*b* which is the first switch are connected via the through hole 16.

As explained in the Embodiment 1, the first line 14 and the first passive element 11 are disposed in parallel with each other and the gap d1 is made to be shorter than the wavelength of a radio frequency, so that the bad influence on the antenna performance can be reduced or substantially negligible.

FIG. 6B shows a positional relationship with respect to the direction of z between the excitation element 1 and the passive element 11.

In the diagram, d2 denotes the gap in the direction of z between the excitation element 1 and the first passive element 11. Note that, the excitation element 1 and the first passive element 11 are located at different positions with respect to the direction of y. Further, these relations can be assumed to be same for a cross section of a portion centered at another switch.

As explained in the aforementioned Embodiment 1, the excitation element 1 is disposed apart from the plane on which the passive elements 11 and 21 are disposed (in this embodiment, one main surface of the second dielectric substrate 15), and by making the gap d2 be shorter than the wavelength of the signal having the above-mentioned radio frequency, the bad influence on the antenna performance can be reduced or substantially negligible, as compared with the case in which the excitation element 1 is disposed on the same plane.

Because the components other than the above-explained components and the operations are the same as those described in the aforementioned Embodiment 1, the explanation of the components and the operations will be omitted.

FIG. 7 is a diagram showing the main lobe in directional characteristics in the Embodiment 3 of the present invention. Two patterns 300*a* and 300*b* of the main lobe between which switching is performed in accordance with control of the switches are described in the same diagram. Further, in order to improve the legibility, the description of some reference numerals is omitted in the diagram.

Because the reflecting plate 34 exists in this embodiment, the radio wave radiated from the antenna device 400 is radiated into half space in the direction of +z (in the direction of the upper side of the diagram), the main lobe is oriented toward the direction of +z regardless of the control of the passive elements and is also oriented toward the direction of +y or the direction of −y in accordance with the control.

As explained above, the antenna device according to this embodiment provides the same effects as those provided by the aforementioned Embodiment 1.

Further, the dielectric substrate on which the excitation element 1 is disposed, and the dielectric substrate on which the passive elements and so on are disposed are formed as different substrates, and therefore these dielectric substrates can be produced individually. Therefore, the production of the antenna device is facilitated.

Further, because the antenna device includes the reflecting plate 34, the supporting structure is formed by the dielectric substrates 6 and 15 and the reflecting plate 34, so that the structure of the antenna device 400 can be strengthened.

In addition, in a case in which the lines 35 and 36 are formed on another dielectric substrate (not shown in the diagrams), and this dielectric substrate is secured, like the dielectric substrate 5, the structure of the antenna device 400 can be further strengthened.

Various variations similar to the variations made to each of the aforementioned embodiment may be made to the same components and operations as those of each of the aforementioned embodiments.

Embodiment 4

Hereinafter, Embodiment 4 of the present invention will be explained with reference to FIGS. 8 to 11.

Note that, there is a case in which the explanation of the same or similar components as those explained in each of the aforementioned embodiments is omitted.

Figure 8:
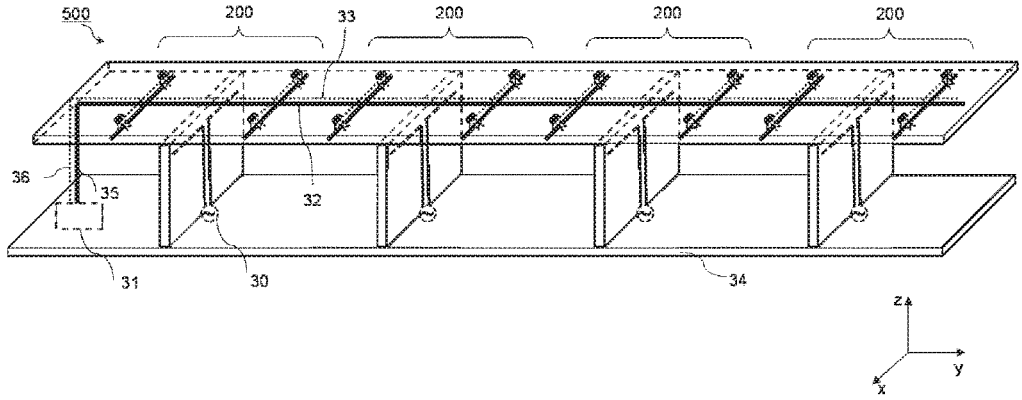
FIG. 8 is a perspective view showing, in a transparent view, an overview of an array antenna device according to an Embodiment 4 of the present invention.

FIG. 8 is a perspective view showing, in a transparent view, an overview of an array antenna device according to the Embodiment 4 of the present invention.

In the diagram, 500 denotes the array antenna device.

In order to improve legibility, only a part of the components is denoted by reference numerals, but the components are same to those of each of the aforementioned embodiments.

The array antenna device according to this embodiment differs from the antenna device according to the above-mentioned Embodiment 3 mainly in that (1) in a single device, a plurality of element parts 200 are disposed on an identical dielectric substrate, (2) the third lines 32 of the plurality of element parts 200 are connected to one another and the fourth lines 33 of the plurality of element parts are also connected to one another, so that the control is performed by a common control circuit 31, and (3) a radio frequency signal source 30 is disposed in each of the element parts 200.

Because the operation of each of the element parts 200 is the same as that of the Embodiment 3, the explanation of the operation will be omitted.

Figure 9:
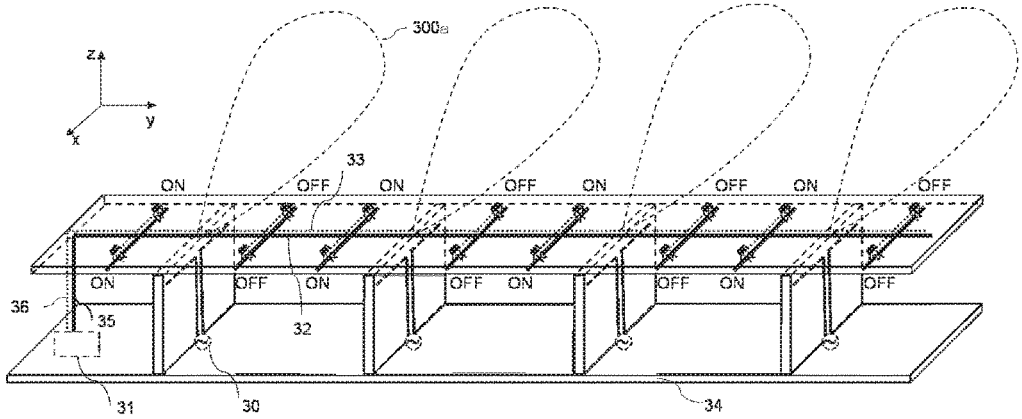
FIG. 9 is a diagram showing a state of each switch and a main lobe in directional characteristics, in the Embodiment 4 of the present invention.
Figure 10:
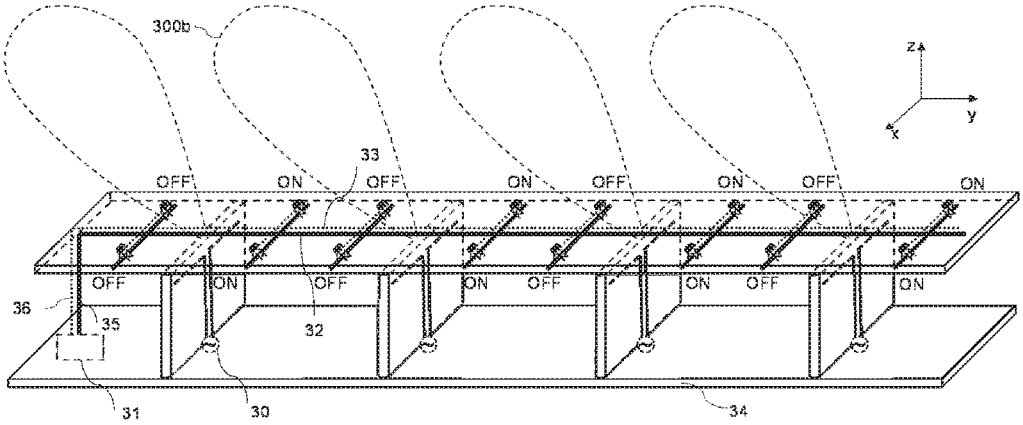
FIG. 10 is a diagram showing a state of each switch and a main lobe in the directional characteristics, in the Embodiment 4 of the present invention.

FIGS. 9 and 10 are diagrams showing the state of each switch and the main lobe in directional characteristics, in the Embodiment 4 of the present invention.

In the diagram, ON shows a state in which a switch is conducting, and OFF shows a state in which a switch is not conducting.

This embodiment is an example in which the plurality of element parts 200 are disposed at equal intervals.

The difference between the state shown in FIG. 9 and that shown in FIG. 10 is that the operating states of the switches of the two passive elements of each of the element parts 200 are opposite to each other.

It can be seen that because the switches 12 and 22 of each of the element part 200 are controlled by the same control signal, the main lobe of the radio wave radiated from each of the element parts 200 is oriented toward the similar direction.

However, the directional characteristics of each of the element parts 200 actually differ in many cases, in accordance with the gap between adjacent element parts 200 and the degree of mutual interference between element parts 200.

As mentioned above, the antenna device according to this embodiment provides the same effects in each of the element parts as those of the above-mentioned Embodiment 3.

Further, even in a case where a plurality of element parts 200 is arranged in one antenna device, it is possible to provide an array antenna device with suppressing the complexity of the configuration for controlling the directional characteristics.

Various variations may be applied to the same components and operations as those of the embodiments described before, and variously modified antenna devices can be configured.

Further, although the example in which four element parts 200 are disposed is explained in this embodiment, the number of element parts is not limited to four and can be another number.

In addition, although the example in which the element parts are disposed along the direction of y in the diagram is shown in this embodiment, a plurality of array antenna units each having the configuration of FIG. 8 can be disposed further in the direction of x.

Figure 11:
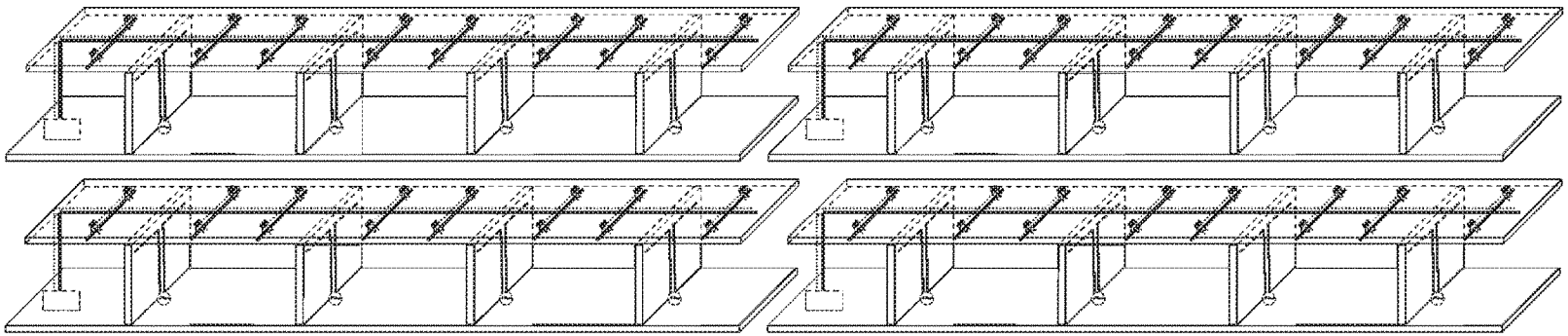
FIG. 11 is a perspective view showing, in a transparent view, an overview of a variation of the array antenna device according to the Embodiment 4 of the present invention.

FIG. 11 is a perspective view showing, in a transparent view, an overview of a variation of the array antenna device according to the Embodiment 4 of the present invention. In order to improve legibility, the description of reference numerals is omitted in the diagram, but the components are same to those of each of the aforementioned Embodiments.

In this case, a plurality of control circuits 31 can perform the same control operation in cooperation with one another, or each of the plurality of control circuits can operate independently.

Further, a plurality of array antenna devices 500 may be arranged in which the number of element parts 200 of the respective array antennas are different to each other. Further, a new array antenna device can be provided by combining the antenna device according to any of the above-mentioned Embodiments 1 to 3, and the array antenna device according to this embodiment.

Further, although the example in which the element parts 200 are disposed at equal intervals is explained in this embodiment, the array antenna device 500 can be configured in such a way that the gap between adjacent element parts 200 has two or more different values, as shown in, for example, nonpatent literature 1.

Embodiment 5

Hereinafter, Embodiment 5 of the present invention will be explained with reference to FIG. 12.

Note that, there is a case in which the explanation of the same or similar operations as those explained in the aforementioned embodiments is omitted.

Figure 12:
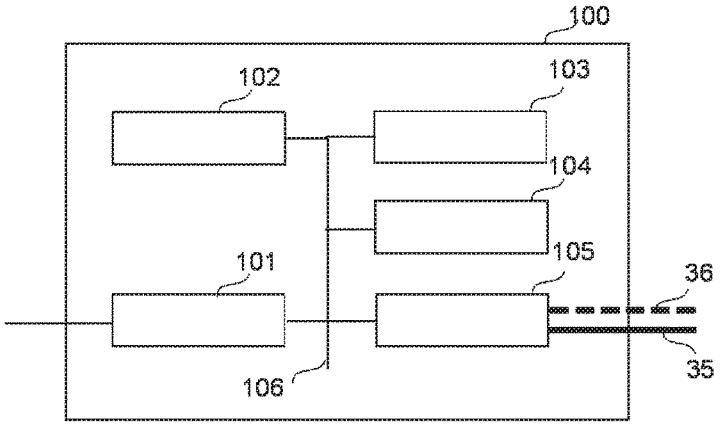
FIG. 12 is a diagram showing an overview of an internal configuration of a controller according to an Embodiment 5 of the present invention.

FIG. 12 is a diagram showing an overview of the internal configuration of a controller 100 according to the Embodiment 5 of the present invention. By taking a relation with the explanation of each of the aforementioned embodiments into consideration, the controller can also be regarded as the control circuit 31.

In the diagram, 101 denotes a Control Interface, 102 denotes a CPU (Central Processing Unit), 103 denotes a RAM (Random Access Memory), 104 denotes a ROM (Read Only Memory), 105 denotes a variable DC power supply, and 106 denotes a Bus.

It is also possible to define a controller 100 in a narrow sense which does not include some components shown in the diagram. As an alternative, a controller 100 in a broad sense including other components not shown in the diagram, e.g., (1) a display, and (2) a controller provided for controlling devices other than switches can be defined.

The control interface 101 exchanges control information, e.g., 1 or 0 with a device disposed outside the antenna device 400 or the array antenna device 500.

The CPU 102 performs various processes, e.g., processes required to control switches 12 and 22.

The RAM 103 and the ROM 104 store various pieces of information, e.g., programs for performing control on the switches 12 and 22.

The variable DC power supply 105 has a control input unit (not shown in the diagram), and performs a control operation of either applying or not applying a direct current signal between lines 35 and 36 in accordance with, for example, control information from the control interface 101.

For example, when 1 or 0 is inputted as the control information, the variable DC power supply applies either a positive voltage or a negative voltage as the direct current signal between the lines, respectively.

The variable DC power supply 105 also controls the polarity and the magnitude of the direct current signal when applying this direct current signal.

The bus 106 connects among the components shown in the diagram and transmits various signals and various pieces of information.

In this embodiment, a control operation is performed by the controller 100 (or the control circuit 31) according to any or all of the above-mentioned embodiments.

For example, in a case in which the antenna device 400 (or the array antenna device 500) is configured in such a way that a control signal is applied manually, the control interface 101 and the variable DC power supply 105 can be configured to correspond to the control circuit 31. Further, in a case in which, for example, the antenna device (or the array antenna device) is configured so as to be controlled automatically by a program, the CPU 102, the RAM 103, the ROM 104, and the variable DC power supply 105 can be configured to correspond to the control circuit 31.

Because an overview of the operation of the controller 100 (or the control circuit 31) is the same as that of each of the embodiments described before, the explanation of the overview will be omitted.

As described above, the antenna device according to this embodiment corresponds to that of each of the aforementioned embodiments, and provides the same effects as those provided by the embodiments.

Although the CPU 102 shown in FIG. 12 according to this embodiment is simply denoted as a CPU in the above-mentioned explanation, instead of the CPU, any devices which can implement processing represented by arithmetic operations or the like can be used. For example, (1) a microprocessor, (2) an FPGA (Field Programmable Gate Array), (3) an ASIC (Application Specific Integrated Circuit), or (4) a DSP (Digital Signal Processor) can be adopted.

Further, the processing can be either of (1) analog processing, (2) digital processing, (3) processing including both analog processing and digital processing. In addition, as the implementation of the processing, (1) implementation using hardware, (2) implementation using software (program), or (3) implementation including both implementation using hardware and implementation using software can be provided.

Further, although the RAM 103 according to this embodiment is simply denoted as a RAM in the above-mentioned explanation, any devices that can store and hold data in a volatile form can be adopted. For example, as the RAM, (1) an SRAM (Static RAM), (2) a DRAM (Dynamic RAM), (3) an SDRAM (Synchronous DRAM), or (4) a DDR-SDRAM (Double Data Rate SDRAM) can be provided.

Further, as the implementation of the control operation, (1) implementation using hardware, (2) implementation using software (program), or (3) implementation including both implementation using hardware and implementation using software can be provided.

Further, although the ROM 104 according to this embodiment is simply denoted as a ROM in the above-mentioned explanation, any devices that can store and hold data can be adopted. For example, in the place of the ROM, (1) an EPROM (Electrical Programmable ROM), or (2) an EEPROM (Electrically Erasable Programmable ROM) can be provided. In addition, as the implementation of the ROM, implementation using hardware, implementation using software (program), or implementation including both implementation using hardware and implementation using software can be provided.

Further, the descriptions of signals and pieces of information carried via the bus 106 connecting among the units shown in the diagram may be changed in accordance with how the internal structure of the antenna device 400 and that of the array antenna device 500 are divided. In such cases, for each signal and for each piece of information, a different information attribution showing either (1) whether or not it is implemented explicitly or (2) whether or not it is defined explicitly can be provided.

Further, to various processes or operations in the control of the directional characteristics, various variations including (1) a process of modifying the processes or operations to substantially equivalent (or corresponding) processes (or operations) and implementing these processes (or operations), (2) a process of dividing the processes or operations into a plurality of equivalent processes and implementing these processes, (3) a process of implementing the process, when there exist a process common in a plurality of blocks, as a process of the block, and (4) a process of causing a certain block to implement the various processes or operations collectively, can be made within the scope of the problems and the effects of the present invention.

Embodiment 6

Hereinafter, Embodiment 6 of the present invention will be explained with reference to FIGS. 13 to 15.

Note that, there is a case in which the explanation of the same or similar components and the operations of the components as those explained in each of the aforementioned Embodiments is omitted.

Figure 13:
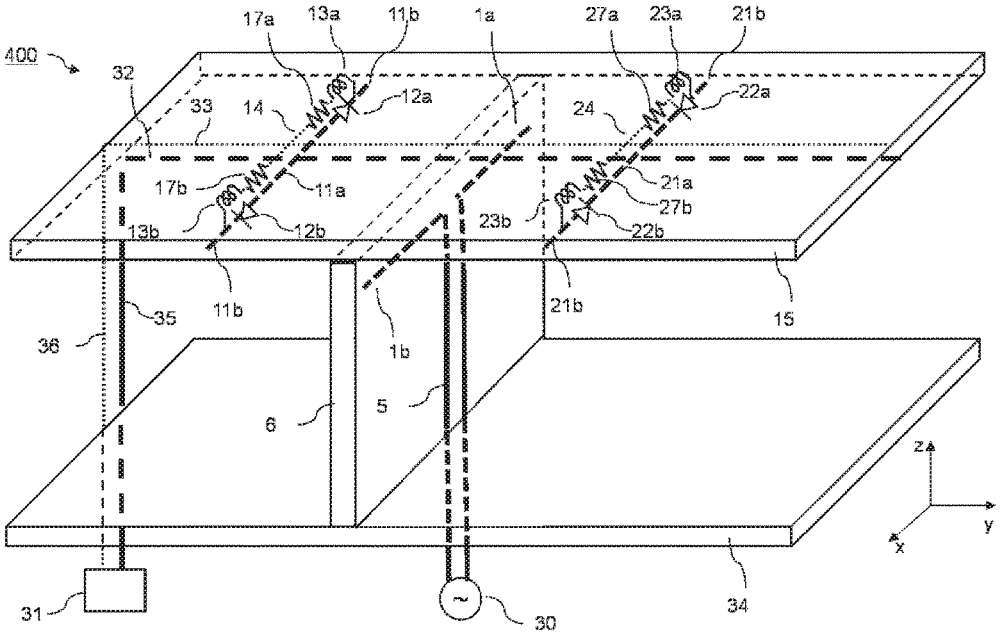
FIG. 13 is a perspective view showing, in a transparent view, an overview of an antenna device according to an Embodiment 6 of the present invention.

FIG. 13 is a perspective view showing, in a transparent view, an overview of an antenna device according to the Embodiment 6 of the present invention. How components are shown in the diagram is the same as that shown in FIG. 5 according to the Embodiment 3.

Figure 14:
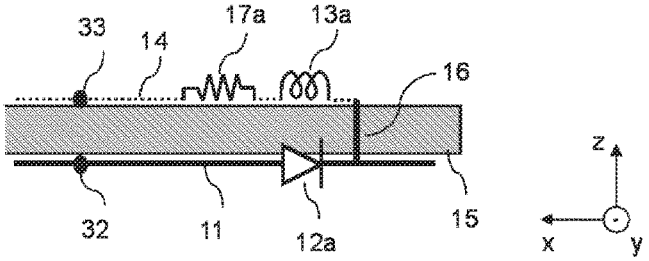
FIG. 14 is a diagram showing a cross-sectional configuration (partial configuration) in the Embodiment 6 of the present invention.

FIG. 14 is a diagram showing a cross-sectional configuration (partial configuration) in the Embodiment 6 of the present invention.

In this diagram, a cross section in the x-z plane including a first switch 12*a* is mainly shown. How components are shown in the diagram is the same as that shown in FIG. 6A according to the Embodiment 3.

In the diagrams, 17 (17*a* and 17*b*) denotes a first resistance part, and 27 (27*a* and 27*b*) denotes a second resistance part. The other components are the same as those described in Embodiment 3.

The antenna device according to this embodiment differs from that of the Embodiment 3 mainly in that the first resistance parts 17 and the second resistance parts 27 are added.

Each of the first resistance parts 17 has resistance characteristics for direct current. As an implementation example of each of the first resistance parts 17, for example, a resistance element provided as independent discrete circuit element can be used. Further, each of the first resistance parts 17 and a first interrupter 13 are connected in series to each other.

In the configuration shown in FIGS. 3 and 4, a first line 14 is connected to second conductive parts 11*b* further via the first resistance parts 17 connected in series to first interrupters 13. Therefore, a fourth line 33 is similarly connected to the second conductive parts 11*b* via the first resistance parts 17 and the first interrupters 13.

Note that, although a line is formed between each of the first resistance parts 17 and the corresponding first interrupter 13 in the configuration shown in FIGS. 13 and 14, this embodiment is not limited to the configuration shown in the diagrams, and the antenna device can be configured in such a way that no line is formed between each of the first resistance parts 17 and the corresponding first interrupter 13, i.e., each of the first resistance parts is directly connected to the corresponding first interrupter.

Because the second resistance parts 27 are configured in the same way as the above-mentioned first resistance parts 17, the explanation of the second resistance parts will be omitted.

Next, the principle of the operation of the antenna device according to this embodiment will be explained while making a comparison with that according to the Embodiment 3.

Figure 15:
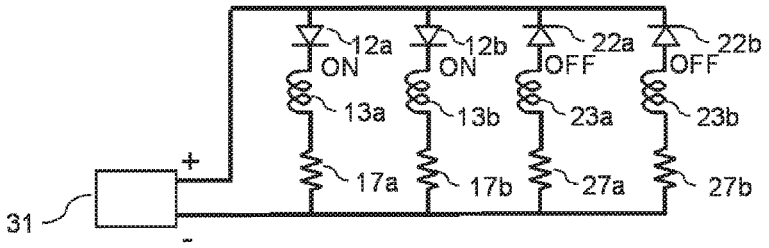
FIG. 15 is a diagram showing an equivalent circuit for the direct current in the Embodiment 6 of the present invention.

FIG. 15 is a diagram showing an equivalent circuit for direct current in the Embodiment 6 of the present invention.

In the diagram, ON shows a state in which a switch (PIN diode) is conducting, and OFF shows a state in which a switch is not conducting. Further, + and − shown in the diagram show the polarity of a direct current signal outputted from a control circuit 31.

The fundamental operation of the antenna device is the same as that according to the Embodiment 3.

In above-mentioned Embodiment 3, when the direct current signal is outputted from the control circuit 31 to a line pair 35 and 36, a forward bias is applied to the PIN diodes (in the diagram, denoted by 12) of one passive element and the PIN diodes are brought into conduction (i.e., ON state), while a reverse bias is applied to the PIN diodes (in the diagram, denoted by 22) of the other passive element and are brought out of conduction (referred to as OFF state from here on). By then switching the polarity of the direct current signal outputted from the control circuit 31, the directional characteristics of the antenna device are switched.

Assuming a case in which the direct voltage outputted from the control circuit 31 has a polarity as shown in FIG. 15, the PIN diodes 12*a* and 12*b* are brought into conduction (ON state) while the PIN diodes 22*a* and 22*b* are brought out of conduction (OFF state).

It can be assumed that inductors 13 (13*a*, 13*b*), which are first interrupters, and inductors 23 (23*a*, 23*b*), which are second interrupters, theoretically have a resistance of zero with respect to direct current.

Therefore, in the above Embodiment 3, when a bias voltage is applied to each of the PIN diodes, the bias voltage applied to each PIN diode brought into conduction (ON) and that applied to each PIN diode brought out of conduction (OFF state) are identical.

When the forward bias current is increased to bring a PIN diode into conduction (ON state), the PIN diode is not brought into conduction (ON state) if the bias current=0 (hence the bias voltage=0). When the bias current is then increased and the PIN diode is brought into conduction (ON state), the passive element connected to the PIN diode operates as a reflector of the antenna device 400.

On the other hand, when the reverse bias voltage is increased to bring a PIN diode out of conduction (OFF state), the PIN diode is theoretically brought out of conduction (OFF state) even if the bias voltage=0, but the reactance of the equivalent circuit of the diode varies in accordance with the variation in the bias voltage, and therefore there is a possibility that the operation of the antenna device becomes unstable.

In consideration of the above-mentioned fact, it is desirable to change the bias condition suitable for PIN diodes between conduction (ON) and non-conduction (OFF). As an example of this case, there can be considered an example in which (1) in the case of conduction (ON), the bias current is set to have a value of approximately several tens of mA (or the bias voltage causing the current to have a value of approximately 1V), and (2) in the case of non-conduction (OFF), the bias voltage is set to have a value of approximately minus several volts (i.e., a bias voltage causing a bias current which can be assumed to be substantially zero). (However, it is not necessary to limit or fix the bias voltage or the bias current to the above-mentioned concrete value, and the above-mentioned value may differ in accordance with examples of the implementation of the antenna device).

Because the bias voltage having the same value is applied to all the PIN diodes in the above Embodiment 3, it can be seen that there is a possibility of the following (1) and (2). (1) The reverse bias voltage is not adequate for a PIN diode brought out of conduction (OFF state) in the case in which the antenna device 400 is produced on the condition that the absolute value of the direct voltage outputted from the control circuit 31 is optimized for conduction (ON state), for example, the absolute value is set to approximately 1V, as mentioned above. (2) The bias is excessive for a PIN diode brought into conduction (ON) state in the case in which the antenna device 400 is produced on the condition that the absolute value of the direct voltage outputted from the control circuit 31 is optimized for non-conduction (OFF state), for example, the absolute value is set to approximately minus several voltages, as mentioned above.

On the other hand, in this embodiment, as shown in FIG. 15, the first resistance parts 17 and the second resistance parts 27 are added to the paths of the direct current signal.

In this case, it can be assumed that the PIN diodes 22*a* and 22*b* brought out of conduction (OFF state) are in a state in which, theoretically, the direct current signal does not flow (a so-called open state, i.e., a state in which their resistances are infinite).

Therefore, because no voltage drop occurs in each of the second resistance parts 27, the voltage (bias voltage) applied to the both ends of each of the PIN diodes 22 becomes equal to that of the Embodiment 3. Namely, the direct voltage outputted from the control circuit 31 is applied to the PIN diodes, theoretically just as it is, regardless of the resistance values of the second resistance parts 27*a* and 27*b*.

Because the direct current flows into the PIN diodes 12*a* and 12*b* which are brought into conduction (ON), it can be seen that a voltage drop occurs due to each of the first resistance parts 17, and the voltage applied to the both ends of each of the PIN diodes (i.e., the bias voltage applied to each of the PIN diodes) is low compared with that in the case of above-mentioned Embodiment 3.

Therefore, it can be seen that in this embodiment, different bias conditions can be provided for PIN diodes at the time of conduction (ON state) and PIN diodes at the time of non-conduction (OFF state). Namely, different bias conditions can be provided for PIN diodes at the time of applying a forward bias and PIN diodes at the time of applying a reverse bias.

As a method of determining the output voltage of the control circuit 31 and the resistance values of the above-mentioned resistance parts, for example, the following method can be adopted. (1) the control circuit 31 is configured in such a way that the reverse bias voltage applied to PIN diodes at the time of non-conduction (OFF state) has an appropriate value, and (2) the resistances of the first resistance parts 17 (17*a* and 17*b*) is determined in such a way that the forward bias current supplied to PIN diodes at the time of conduction (ON state) has an appropriate value.

For the case in which the polarity of the output voltage of the control circuit 31 is inverted in order to change the directional characteristics of the antenna device 400, the resistance values of the second resistance parts 27 (27*a* and 27*b*) can be determined to have an appropriate value in the same way explained above.

In a case in which all the diodes have the same characteristics, the first resistance parts 17 and the second resistance parts 27 can be determined to have the same resistance.

As described above, the antenna device according to this embodiment provides the same effects as those provided by the Embodiment 3.

Further, the bias condition (voltage or current) for the PIN diodes can be set to be different for the time of conduction (ON) and for the time of non-conduction (OFF state).

By applying an appropriate forward bias current (or a forward bias voltage causing the bias current to flow) to the PIN diodes, the radiation pattern of the antenna device can be changed certainly.

Further, by applying an appropriate reverse bias voltage (or a reverse bias voltage at which the current flowing through the PIN diodes can be assumed to be practically zero) to the PIN diodes, it is possible to prevent the following phenomena: when the electric power of the radio frequency signal is high during the operation of the antenna device 400, a part of the electric power passes the non-conduction side PIN diodes (OFF state), so that the changing of the radiation pattern becomes inadequate.

In addition, because the bias condition (voltage or current) for the PIN diodes is set to be different for the time of conduction (ON) and for the time of non-conduction (OFF state), the change of the antenna characteristics caused by bias voltage variation can be reduced by applying an appropriate reverse bias voltage. As a result, the operation and the performance of the antenna device can be stabilized.

Note that, the configuration shown in the diagrams of this embodiment is an example of applying this embodiment to a configuration, like the configuration as shown in FIG. 15 according to the Embodiment 3, including a first dielectric substrate 6, a second dielectric substrate 15 and a reflecting plate 34. As an alternative, the configuration shown in the diagrams of this embodiment can be applied to the configuration shown in the diagrams in any of other Embodiments 1, 2, 4 and 5, to create a new embodiment, and this new embodiment provides the same effects as those provided by the present embodiment.

Further, as the configuration of the control circuit 31, the configuration of the control circuit shown in the Embodiment 5 can be applied, like in the case of any of the Embodiments 41 to 4.

Embodiment 7

Hereinafter, Embodiment 7 of the present invention will be explained with reference to FIGS. 16 to 19

Note that, there is a case in which the explanation of the same or similar components and the operations of the components as those explained in the above-mentioned Embodiment 6 is omitted.

Figure 16:
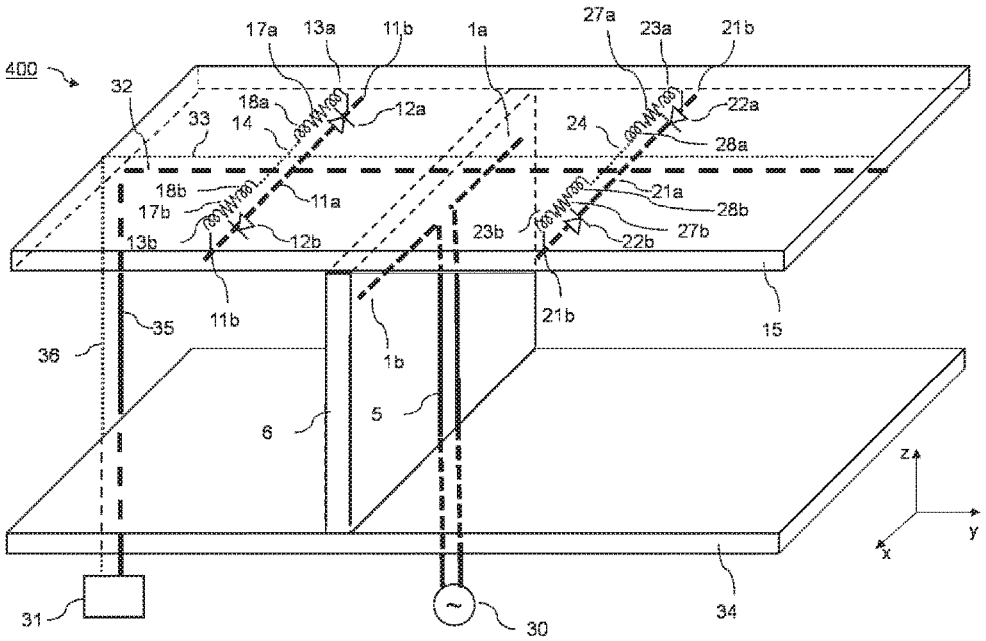
FIG. 16 is a perspective view showing, in a transparent view, an overview of an antenna device according to an Embodiment 7 of the present invention.

FIG. 16 is a perspective view showing, in a transparent view, an overview of an antenna device according to the Embodiment 7 of the present invention. How components are shown in the diagram is the same as that shown in FIG. 13 according to the Embodiment 6.

Figure 17:
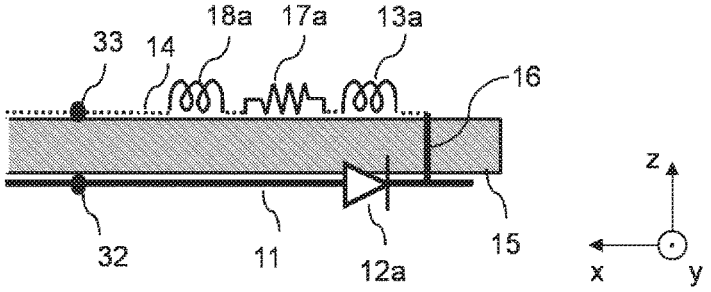
FIG. 17 is a diagram showing a cross-sectional configuration (partial configuration) in the Embodiment 7 of the present invention.

FIG. 17 is a diagram showing a cross-sectional configuration (partial configuration) in the Embodiment 7 of the present invention.

In this diagram, a cross section in the x-z plane including a first switch 12*a* is mainly shown. How components are shown in the diagram is the same as that shown in FIG. 14 according to the Embodiment 6.

In the diagrams, 18 (18*a* and 18*b*) denotes a third interrupter, and 28 (28*a* and 28*b*) denotes a fourth interrupter. The other components are the same as those according to the Embodiment 6.

The antenna device according to this embodiment differs from that according to the Embodiment 6 mainly in that the third interrupters 18 and the fourth interrupters 28 are added.

While each of the third interrupters 18 has interrupt characteristics at an assumed radio frequency (or in an assumed radio frequency band), each of the interrupters allows a DC bias which is a control signal from a controller 100 (control circuit 31) to pass therethrough. As an implementation example of each of the third interrupters 18, for example, the same circuit element (inductor) as that used as each of the first and second interrupters can be used. However, this embodiment is not limited to a case in which all of the first through fourth interrupters are circuit elements having the same characteristics.

Further, each of the third interrupters 18 is connected in series to a first interrupter 13 and a first resistance part 17, and is connected in such a way as to sandwich the first resistance part 17 between itself and the first interrupter 13.

In the configuration shown in the diagrams, a first line 14 is connected to second conductive parts 11 further via the third interrupters 18 which are respectively connected in series to the first resistance parts 17. Therefore, a fourth line 33 is similarly connected to the second conductive parts 11 via the third interrupters 18, the first resistance parts 17 and the first interrupters 13.

Although a line is formed between each of the first resistance parts 17 and the corresponding third interrupter 18 in the configuration shown in FIG. 17, this embodiment is not limited to the configuration shown in the diagram. The antenna device can be configured in such a way that no line is formed between each of the first resistance parts 17 and the corresponding third interrupter 18, i.e., each of the first resistance parts is directly connected to the corresponding third interrupter.

Further, although a line is formed between each of the first resistance parts 17 and the corresponding first interrupter 13 in the configuration shown in FIG. 17 like in the case of the above-mentioned embodiment 6, this embodiment is not limited to the configuration shown in the diagram. The antenna device can be configured in such a way that no line is formed between each of the first resistance parts 17 and the corresponding first interrupter 13, i.e., each of the first resistance parts is directly connected to the corresponding first interrupter.

Because the fourth interrupters 28 are configured in the same way as the third interrupters 18, the explanation of the fourth interrupters will be omitted.

Next, the principle of the operation of the antenna device according to this embodiment will be explained while making a comparison with that according to the Embodiment 6.

Because the third and fourth interrupters 18 and 28 operate in the same way that the first and second interrupters 13 and 23 operate for the direct current, the fundamental operation of the antenna device is the same as that according to the Embodiment 6.

In the above-mentioned Embodiment 6 and this embodiment, the antenna device has the first resistance parts 17 (17*a*, 17*b*) and the second resistance parts 27 (27*a*, 27*b*).

In this case, in each of the resistance parts, a loss may occur for a radio frequency signal.

This is because each of the resistance parts 17 serves as a distributed constant circuit equivalently when the size of the resistance part 17 cannot be negligible with respect to the wavelength of an assumed radio frequency signal (or an assumed radio frequency band signal). For this reason, a radio frequency signal flows through each of the resistance parts 17, and this results in the occurrence of a loss.

According to this embodiment, the first interrupter (inductor) 13*a* and the third interrupter 18*a* are connected to each other in such a way as to sandwich the first resistance part 17*a* between them.

Because the first resistance part 17*b* and the second resistance parts 27*a* and 27*b* are configured in the same way as the first resistance part 17*a*, the explanation of them will be omitted.

Because each of the resistance parts shown in the diagrams is sandwiched between two interrupters, the path of the current having a radio frequency can be interrupted more accurately.

As mentioned above, the antenna device according to this embodiment provides the same effects as those provided by the above-mentioned Embodiment 3.

Further, because the antenna device has the resistance parts like the Embodiment 6, the bias condition (voltage or current) for the PIN diodes can be set to be different for the time of conduction (ON) and for the time of non-conduction (OFF state), like in the case of the Embodiment 6.

Therefore, by applying an appropriate forward bias current (or a forward bias voltage causing the current to flow) to the PIN diodes, the radiation pattern of the antenna device can be changed certainly.

In addition, by setting the bias condition (voltage or current) for the PIN diodes to be different for the time of conduction (ON) and for the time of non-conduction (OFF state), the change of the antenna characteristics which is caused by voltage variation can be reduced by applying an appropriate reverse bias voltage. As a result, the operation and the performance of the antenna device can be stabilized.

Further, by sandwiching each of the resistance parts between two interrupters, the occurrence of a loss in the radio frequency signal in each of the resistance parts can be suppressed, and therefore the power of the radio frequency signal as the output of the antenna device 400 can be increased.

Although the configuration in which each of the interrupters is connected in series to a resistance part in the path of the direct current signal is explained above, another circuit element or a connection relationship for suppressing the occurrence of a loss in the radio frequency signal in each of the resistance parts can be alternatively used, as will be shown below.

Figure 18:
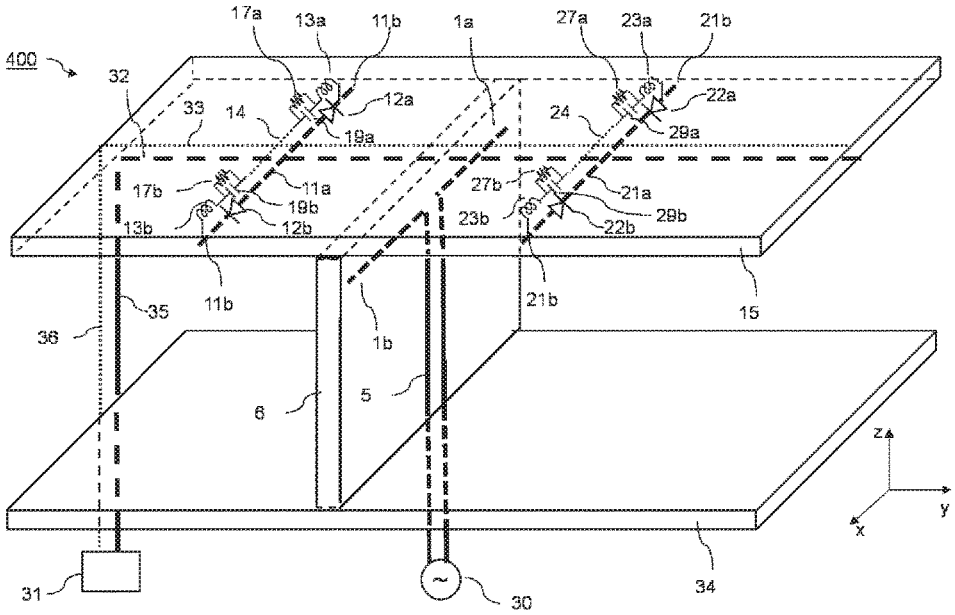
FIG. 18 is a perspective view showing, in a transparent view, an overview of an antenna device according to a variation of the Embodiment 7 of the present invention.

FIG. 18 is a perspective view showing, in a transparent view, an overview of an antenna device according to a variation of Embodiment 7 of the present invention.

Figure 19:
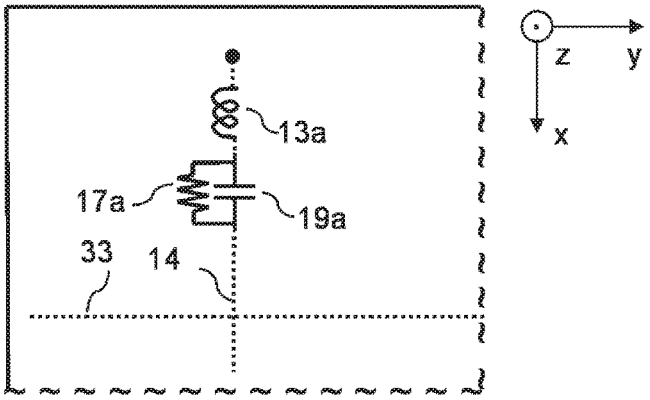
FIG. 19 is a diagram showing a planar configuration (partial configuration) viewed from an upper side of the antenna device according to the variation of the Embodiment 7 of the present invention.

FIG. 19 is a diagram showing a planar configuration (partial configuration) viewed from the upper side of the antenna device according to the variation of Embodiment 7 of the present invention. In the diagram, a plane view of the upper surface of a dielectric substrate 15 is mainly shown.

In the diagrams, 19 (19*a* and 19*b*) denotes a first passage part, and 29 (19*a* and 29*b*) denotes a second passage part. The configuration shown in the diagrams is an example in which capacitors are used as the first passage parts 19 and the second passage parts 29.

The configuration shown in FIG. 18 differs from that shown in FIG. 16 in that the first passage parts 19 are disposed instead of the third interrupters 18 and the second passage parts 29 are disposed instead of the fourth interrupters 28.

Each of the first passage parts 19 (19*a* and 19*b*) has pass characteristics at an assumed radio frequency (in an assumed radio frequency band). Each of the first passage parts has only to have pass characteristics at an assumed radio frequency (in an assumed radio frequency band) which are required to such an extent that the antenna device satisfies the performance necessary thereto, and does not necessarily have to have ideal pass characteristics.

Further, each of the first resistance parts 17 and the corresponding first passage part 19 are connected in parallel with each other. Therefore, in the configuration shown in the diagrams, the first line 14 is connected to the second conductive parts 11 via the first interrupters 13, and the sets of a first resistance part 17 and a first passage part 19 which are connected in parallel with each other. Therefore, the fourth line 33 is similarly connected to the second conductive parts 11 via: the first interrupters 13; and the sets of a first resistance part 17 and a first passage part 19 which are connected in parallel with each other.

Because the second passage parts 29 are configured in the same way as the first passage parts 19, the explanation of the second passage parts will be omitted.

Next, the principle of the operation of the antenna device according to this embodiment will be explained.

The fundamental operation is the same as that according to any of the Embodiments 3 and 6.

The circuit constants of the elements are selected in such a way that the impedances of the first passage parts 19 and the second passage parts 29 at radio frequencies are smaller than those of the first resistance parts 17 and the second resistance parts 27. As a result, the radio frequency signal flowing through each of the resistance parts can be suppressed, and therefore the occurrence of a loss in the radio frequency signal can be suppressed.

The configuration shown in the diagrams of this embodiment is an example of applying this embodiment to a configuration, like the configuration according to any of the above-mentioned Embodiments 3 and 6, including a first dielectric substrate 6, a second dielectric substrate 15 and a reflecting plate 34. As an alternative, the configuration of this embodiment can be applied to the configuration shown in the diagrams in any of the other Embodiments 1, 2, 4 and 5, to create a new embodiment, and this new embodiment provides the same effects as those provided by the present embodiment.

Further, instead of the parallel connection circuit, shown in above-mentioned FIG. 18, in which a resistance part 17 (27) and a passage part 19 (29) are connected in parallel with each other, a circuit whose equivalent circuit on direct current and at radio frequencies has the same characteristics as the parallel connection circuit can be used.

Further, as the configuration of the control circuit 31, the configuration of the control circuit shown in the above-mentioned Embodiment 5 can be applied, like in the case of any of the above-mentioned Embodiments 41 to 4.

Embodiment 8

Hereinafter, Embodiment 8 of the present invention will be explained with reference to FIGS. 20 to 23.

Note that, there is a case in which the explanation of the same or similar components and operations of the components as those explained in each of the above-mentioned Embodiments will be omitted.

Figure 20:
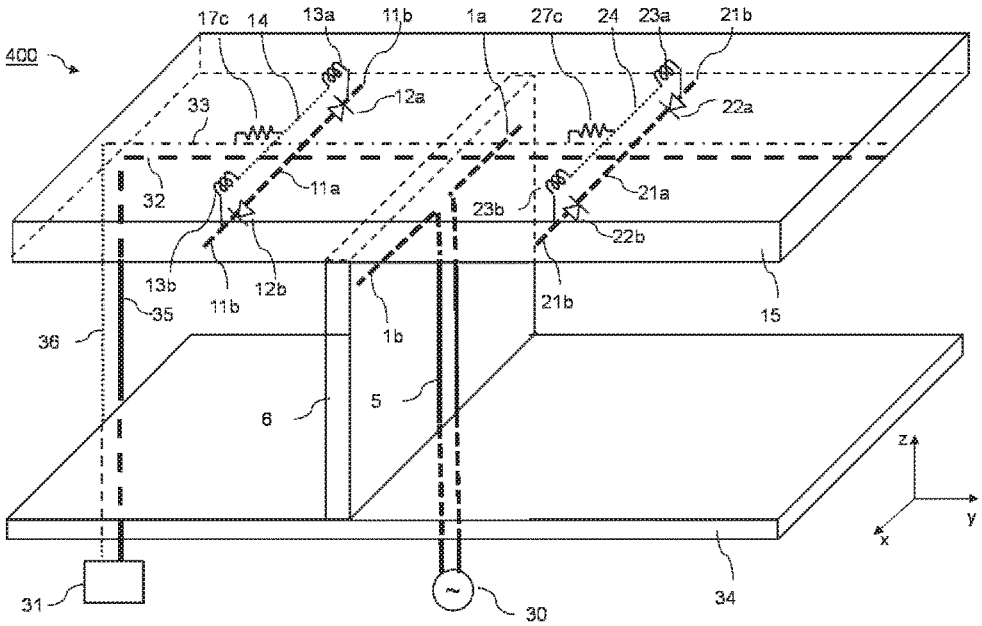
FIG. 20 is a perspective view showing, in a transparent view, an overview of an antenna device according to an Embodiment 8 of the present invention.

FIG. 20 is a perspective view showing, in a transparent view, an overview of an antenna device according to the Embodiment 8 of the present invention.

Figure 21:
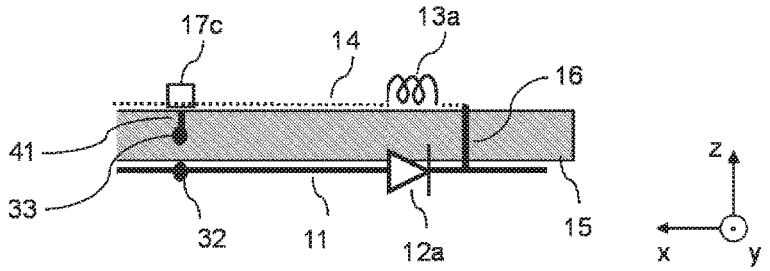
FIG. 21 is a diagram showing a cross-sectional configuration (partial configuration) in the Embodiment 8 of the present invention.

FIG. 21 is a diagram showing a cross-sectional configuration (partial configuration) in the Embodiment 8 of the present invention.

Figure 22:
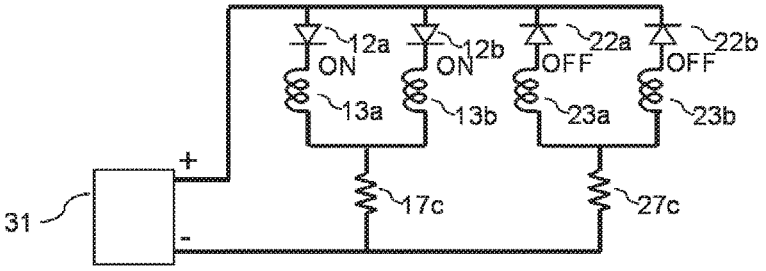
FIG. 22 is a diagram showing an equivalent circuit for the direct current in the Embodiment 8 of the present invention.

FIG. 22 is a diagram showing an equivalent circuit for direct current in the Embodiment 8 of the present invention.

In FIGS. 20 to 22, 17*c* denotes a third resistance part, 27*c* denotes a fourth resistance part, and 41 denotes a through hole. The other components are the same as those according to the Embodiment 3.

In FIG. 21, a cross section in the x-z plane including a first switch 12*a* is mainly shown.

How components are shown in FIG. 21 is the same as that shown in FIG. 6A of the Embodiment 3. The third resistance part 17*c* and the through hole 41 are disposed toward the direction of −y with respect to the first switch 12*a*.

The antenna device according to this embodiment differs from that according to the Embodiment 3 mainly in the following points. (1) The third resistance part 17*c* and the fourth resistance part 27*c* are added. (2) A first line 14 and a fourth line 33 are connected to each other via the third resistance part 17*c* and a second line 24 and a fourth line 33 are connected to each other via the fourth resistance part 27*c*.

The third resistance part 17*c* has resistance characteristics on direct current. As an implementation example of the first resistance part 17, for example, a resistance element disposed as independent discrete circuit element can be used.

The fourth line 33 is formed in the inside of a dielectric substrate 15. The fourth line 33 is not connected directly to the first line 14 and the second line 24 which are formed on a main surface of the dielectric substrate 15.

Therefore, in the configuration shown in the diagrams, the first line 14 is connected to the fourth line 33 via the through hole 41 and the third resistance part 17*c*.

Because the fourth resistance part 27*c* is configured in the same way as the third resistance part 17*c* and the second line 24 is configured in the same way as the first line 14, the explanation of the fourth resistance part and the second line will be omitted.

Next, the principle of the operation of the antenna device according to this embodiment will be explained while making a comparison with that according to the Embodiment 3.

A fundamental operation is the same as that according to the Embodiments 3 and 6.

A direct current operation can be understood as follows: (1) the first resistance part 17*a* and the second resistance part 17*b* shown in FIG. 15 according to the Embodiment 6 are replaced by the third resistance part 17*c* which is used as a common resistance, and (2) the second resistance parts 27*a* and 27*b* are replaced by the fourth resistance part 27*c* which is used as a common resistance.

Therefore, because the operation in the case of setting the bias condition for the PIN diodes, which is set to be different for the time of conduction (ON state) and for the time of non-conduction (OFF state), can be assumed to be same to that of the Embodiment 6, the explanation of the operation will be omitted.

As described above, the antenna device according to this embodiment provides the same effects as those provided by the Embodiment 3.

Further, because the antenna device has the resistance parts, like those according to the Embodiments 6 and 7, the bias condition (voltage or current) for the PIN diodes can be set to be different for the time of conduction (ON) and for the time of non-conduction (OFF state).

As a result, by applying an appropriate forward bias current (or a forward bias voltage causing the bias current to flow) to the PIN diodes, the radiation pattern of the antenna device can be changed certainly.

In addition, because the bias condition (on voltage or current) for the PIN diodes is set to be different for the time of conduction (ON) and for the time of non-conduction (OFF state), the change of the antenna characteristics which is caused by voltage variation can be reduced by applying an appropriate reverse bias voltage, like in the case of the Embodiment 6. As a result, the operation and the performance of the antenna device can be stabilized.

Further, because the third resistance part 17*c* and the fourth resistance part 27*c* exist on the axis of symmetry of the antenna, theoretically, current having the radio frequency does not flow through the resistance parts, and therefore the loss in the radio frequency signal can be suppressed as compared with the Embodiments 6 and 7. Therefore, the power of the radio frequency signal as the output of the antenna device 400 can be increased.

As the configuration of the control circuit 31, the configuration of the control circuit shown in the Embodiment 5 can be applied, like in the case of any of the Embodiments 41 to 4.

Further, although in the above explanation, the configuration in which the through hole is used in the path of the direct current signal is explained, another circuit element or a connection relationship can be alternatively used, as will be shown below.

FIG. 24 is a perspective view showing, in a transparent view, an overview of an antenna device according to a variation of Embodiment 8 of the present invention. How components are shown in the diagram is the same as that shown in FIG. 20.

In the diagram, 37 denotes a first bypass line, and 38 denotes a second bypass line.

The first bypass line 37 and the second bypass line 38 function as conductors for direct current. This embodiment is an example in which arc-shaped conductor wires are used as an implementation example of the first bypass line 37 and the second bypass line 38.

Further, the first line 14, the second line 24, and the fourth line 33 are formed on the same main surface of the dielectric substrate.

The first bypass line 37 can be assumed to be disposed in such a way that the fourth line 33 bypasses the first line 14. Therefore, the first bypass line 37 can be assumed to be a part of the fourth line 33.

The first line 14 and the fourth line 33 are connected to each other via the third resistance part 17*c*, and the second line 24 and the fourth line 33 are connected to each other via the fourth resistance part 27*c*. Therefore, the electric connecting relation for direct current is the same as that shown in FIG. 22 according to the Embodiment 7, so that the explanation of the electric connecting relation will be omitted.

Because the second bypass line 38 is configured in the same way as the first bypass line 37, the explanation of the second bypass line will be omitted.

Figure 23:
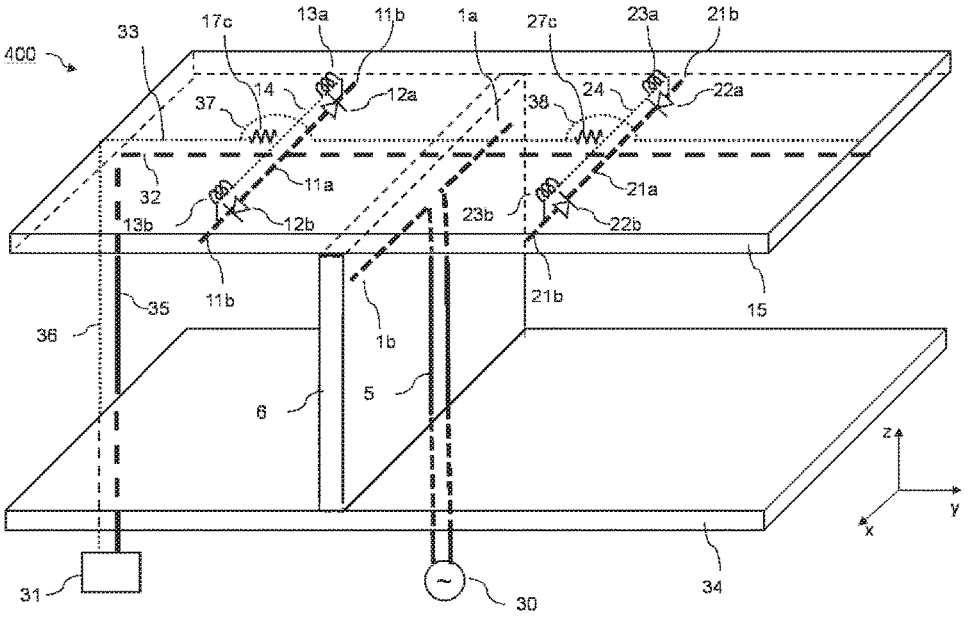
FIG. 23 is a perspective view showing, in a transparent view, an overview of an antenna device according to a variation of the Embodiment 8 of the present invention.

Because the operation of the device shown in FIG. 23 is the same as that explained by using above-mentioned FIGS.

20 to 22, the effects provided by the configuration shown in FIG. 23 are the same as those explained by using FIGS. 20 to 22.

In each of the aforementioned embodiments, an antenna device 400 in a narrow sense and an array antenna device 500 in a narrow sense which do not include part of the illustrated components can be defined. For example, they can be configured so as not to include the controller 100 and the lines 35 and 36. Further, for example, an element part 200 in a narrow sense can be configured so as to include components, among all the illustrated components, disposed at the center of the symmetrical arrangement, and components disposed on one of the both sides of the symmetrical arrangement (and a part of the components), but not include components disposed on the other side of the symmetrical arrangement (and a part of the components).

Further, the dividing pattern of the configuration, the functions and the processes of the antenna device in each of the aforementioned embodiments is merely an example, and the present invention is not limited to the aforementioned embodiments as long as the equivalent functions can be implemented in the antenna device. Further, the array antenna device 500 can be simply called an antenna device.

REFERENCE SIGNS LIST 1 (1*a* and 1*b*) excitation element, 2 feed point, 3 dielectric substrate, 4 patch, 12 (12*a* and 12*b*) first switch (PIN diode), 5 feeder line, 6 dielectric substrate, 11 first passive element, 11*a* first conductive part, 11*b* second conductive part, 13 (13*a* and 13*b*) first interrupter, 14 first line, 15 dielectric substrate, 16 through hole, 17*a* and 17*b* first resistance part, 17*c* third resistance part, 18 (18*a* and 18*b*) third interrupter, 19 (19*a* and 19*b*) first passage part, 21 second passive element, 21*a* third conductive part, 21*b* fourth conductive part, 22 (22*a* and 22*b*) second switch (PIN diode), 23 (23*a* and 23*b*) second interrupter, 24 second line, 27*a* and 27*b* second resistance part, 27*c* fourth resistance part, 28 (28*a* and 28*b*) fourth interrupter, 29 (29*a* and 29*b*) second passage part, 30 radio frequency signal source, 31 control circuit, 32 third line, 33 fourth line, 34 reflecting plate, 35, 36 line, 37 first bypass line, 38 second bypass line, 41 through hole, 100 controller, 200 element part, 101 control interface, 102 processor, 103 RAM, 104 ROM, 105 variable DC power supply, 106 bus, 300 main lobe, 400 antenna device, and 500 array antenna device.

The invention claimed is:

1. An antenna device comprising:

an element part including an excitation element having a feed point for a radio frequency signal;

a first passive element disposed at a position apart from said excitation element and having first conductive part and second conductive part;

a second passive element disposed at a position apart from said excitation element and said first passive element and having third conductive part and fourth conductive part;

a first switch having two operating states of conduction and non-conduction, to switch between electrical connection between said first conductive part and second conductive part, and electrical non-connection between said first conductive part and second conductive part;

a second switch having two operating states of conduction and non-conduction, to switch between electrical connection between said third conductive part and fourth conductive part, and electrical non-connection between said third conductive part and fourth conductive part;

a first line extending in parallel with said first passive element and connected to said second conductive part;

a second line extending in parallel with said second passive element and connected to said fourth conductive part;

a third line connecting between said first conductive part and said third conductive part; and a fourth line connecting between said first line and said second line, and the antenna device further comprising:

a controller to output an electric signal for controlling said conduction and said non-conduction of each of said first and second switches, wherein the antenna device further comprises:

a first dielectric substrate; and a second dielectric substrate having a fixed arrangement relationship with said first dielectric substrate, wherein said excitation element is disposed on one main surface of said first dielectric substrate, said first and second passive elements, said first and second switches, and said third line are disposed on one main surface of said second dielectric substrate, and said first, second and fourth lines are disposed on another main surface of said second dielectric substrate, and wherein said controller outputs an identical direct current signal, as said electric signal, to said first and second switches by applying a direct current signal between said third and fourth lines, and, when said identical direct current signal is outputted from said controller, one of said first and second switches is brought into conduction while the other one of said first and second switches is brought out of conduction.

2. The antenna device according to claim 1, wherein said element part further includes first and second interrupters each having interrupt characteristics at a radio frequency of said radio frequency signal, and said first line is connected to said second conductive part via said first interrupter, and said second line is connected to said fourth conductive part via said second interrupter.

3. The antenna device according to claim 2, wherein said element part further includes: first and second resistance parts each having resistance characteristics for direct current, wherein said first line is connected to said second conductive part further via said first resistance part connected in series to said first interrupter and said second line is connected to said fourth conductive part further via said second resistance part connected in series to said second interrupter.

4. The antenna device according to claim 3, wherein said element part further includes first and second passage parts each having pass characteristics at said radio frequency, wherein said first passage part is connected in parallel with said first resistance part, and said second passage part is connected in parallel with said second resistance part.

5. The antenna device according to claim 2, wherein said element part further includes third and fourth resistance parts, wherein said first line is connected to said fourth line via said third resistance part, and said second line is connected to said fourth line via said fourth resistance part.

6. The antenna device according to claim 1, wherein said excitation element is a dipole antenna, a dipole antenna with a reflecting plate, or a patch antenna.

7. The antenna device according to claim 1, wherein each of said first and second switches is either of a PIN diode, a varactor diode, and a relay switch.

8. The antenna device according to claim 1, wherein said first and second switches are PIN diodes, and said PIN diode of said first switch has an anode connected to said first conductive part, and a cathode connected to said second conductive part, and said PIN diode of said second switch has a cathode connected to said third conductive part, and an anode connected to said fourth conductive part.

9. The antenna device according to claim 1, wherein said antenna device comprises a plurality of element parts each identical to said element part, and said third lines of said plurality of element parts are connected to one another, and said fourth lines of said plurality of element parts are connected to one another.

10. An array antenna device comprising a plurality of antenna devices each according to claim 1.

* * * * *